US009109190B2

(12) United States Patent
Man et al.

(10) Patent No.: US 9,109,190 B2
(45) **Date of Patent: *Aug. 18, 2015**

(54) CLEANING COMPOSITIONS EMPLOYING EXTENDED CHAIN ANIONIC SURFACTANTS

(71) Applicant: Ecolab USA Inc., St. Paul, MN (US)

(72) Inventors: Victor Fuk-Pong Man, St. Paul, MN (US); Michael Charles DeNoma, Vadnais Heights, MN (US); Susan Maloney Viall, Rosemount, MN (US); Steven E. Lentsch, St. Paul, MN (US); Yvonne Marie Killeen, South St. Paul, MN (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/246,928

(22) Filed: Apr. 7, 2014

(65) Prior Publication Data

US 2014/0221267 A1 Aug. 7, 2014

Related U.S. Application Data

(63) Continuation of application No. 13/895,696, filed on May 16, 2013, now abandoned, which is a continuation of application No. 13/535,508, filed on Jun. 28, 2012, now Pat. No. 8,454,709, which is a continuation of application No. 12/884,608, filed on Sep. 17, 2010, now Pat. No. 8,246,696.

(51) Int. Cl.
*C11D 1/12* (2006.01)
*C11D 1/29* (2006.01)
(Continued)

(52) U.S. Cl.
CPC *C11D 1/65* (2013.01); *C11D 1/002* (2013.01); *C11D 1/37* (2013.01); *C11D 1/83* (2013.01); *C11D 1/123* (2013.01); *C11D 1/29* (2013.01); *C11D 1/75* (2013.01)

(58) Field of Classification Search
CPC ..... C11D 1/12; C11D 1/123; C11D 1/29; C11D 1/75; C11D 3/02; B08B 3/04
USPC ..... 510/340, 356, 357, 360, 417, 426, 433, 510/503; 134/25.2, 25.3, 39, 42; 8/137
See application file for complete search history.

(56) References Cited

U.S. PATENT DOCUMENTS 3,871,898 A 3/1975 Reinert et al.
4,492,646 A 1/1985 Welch
(Continued)

FOREIGN PATENT DOCUMENTS

EP 0368146 A2 5/1990
EP 0573341 B1 7/1998
(Continued)

OTHER PUBLICATIONS

Barber, J.A.S., et al., "Fluorescent tracer technique for measuring the quantity of pesticide deposited to soil following spray applications," Elsevier, Crop Protection 22 (2003) pp. 15-21.
(Continued)

*Primary Examiner* — Brian P Mruk
(74) *Attorney, Agent, or Firm* — McKee, Voorhees & Sease, PLC

(57) ABSTRACT

The invention discloses synergistic combinations of surfactants blends and cleaning composition. In certain embodiments a surfactant system is disclosed which includes extended anionic surfactants, linker surfactants, and a multiply charged cation component. This system forms emulsions with, and can remove greasy and oily stains, even those comprised of non-trans fats. The compositions may be used alone, as a pre-spotter or other pre-treatment or as a part of a soft surface or hard surface cleaning composition.

24 Claims, 5 Drawing Sheets

(51) Int. Cl.

| | |
|---|---|
| ***C11D 3/02*** | (2006.01) |
| ***B08B 3/04*** | (2006.01) |
| ***C11D 1/65*** | (2006.01) |
| ***C11D 1/37*** | (2006.01) |
| ***C11D 1/83*** | (2006.01) |
| ***C11D 1/00*** | (2006.01) |
| *C11D 1/75* | (2006.01) |

(56) References Cited

U.S. PATENT DOCUMENTS

| | | | | |
|---|---|---|---|---|
| 5,082,584 | A | 1/1992 | Loth et al. | |
| 5,376,310 | A | 12/1994 | Cripe et al. | |
| 5,393,468 | A | 2/1995 | Erilli et al. | |
| 5,597,507 | A | 1/1997 | Garrett et al. | |
| 5,688,930 | A | 11/1997 | Bertho et al. | |
| 5,707,948 | A | 1/1998 | Evers et al. | |
| 5,888,957 | A | 3/1999 | Durbut et al. | |
| 5,994,283 | A | 11/1999 | Durbut et al. | |
| 6,136,769 | A | 10/2000 | Asano et al. | |
| 6,156,712 | A | 12/2000 | Stringer et al. | |
| 6,228,829 | B1 | 5/2001 | Vinson et al. | |
| 6,274,874 | B1 | 8/2001 | Sidhu | |
| 6,277,808 | B1 | 8/2001 | Tcheou et al. | |
| 6,472,364 | B1 | 10/2002 | Heltovics | |
| 6,511,954 | B1 | 1/2003 | Wilbur et al. | |
| 6,589,926 | B1 | 7/2003 | Vinson et al. | |
| 6,613,726 | B1 | 9/2003 | Gagliardi et al. | |
| 6,740,627 | B1 | 5/2004 | Clarke et al. | |
| 6,827,795 | B1 | 12/2004 | Kasturi et al. | |
| 7,037,884 | B2 | 5/2006 | Man | |
| 7,467,633 | B2 | 12/2008 | Smith et al. | |
| 8,246,696 | B2 * | 8/2012 | Man et al. | 8/137 |
| 8,454,709 | B2 * | 6/2013 | Man et al. | 8/137 |
| 8,580,727 | B2 * | 11/2013 | Man et al. | 510/340 |
| 8,785,363 | B2 * | 7/2014 | Man et al. | 510/340 |
| 2001/0026942 | A1 | 10/2001 | Carpenter et al. | |
| 2002/0193268 | A1 | 12/2002 | Embleton et al. | |
| 2003/0139313 | A1 | 7/2003 | Turner et al. | |
| 2006/0165739 | A1 * | 7/2006 | Komesvarakul et al. | 424/401 |
| 2006/0211593 | A1 * | 9/2006 | Smith et al. | 510/424 |
| 2007/0143032 | A1 | 6/2007 | Wieringa et al. | |
| 2008/0207981 | A1 | 8/2008 | Hoag et al. | |
| 2009/0183877 | A1 | 7/2009 | Quintero et al. | |
| 2009/0208051 | A1 | 8/2009 | Emo et al. | |
| 2009/0223635 | A1 | 9/2009 | Lawless | |
| 2009/0261270 | A1 | 10/2009 | Carling | |

FOREIGN PATENT DOCUMENTS

| | | | |
|---|---|---|---|
| JP | 63073140 | A | 4/1988 |
| JP | 1100442 | A | 4/1989 |
| JP | 10292199 | A | 11/1998 |
| JP | 2001246339 | | 9/2001 |
| JP | 2009210514 | | 9/2009 |
| WO | WO 9732962 | | 9/1997 |
| WO | WO 9927054 | | 6/1999 |
| WO | WO 0068348 | | 11/2000 |
| WO | WO 2007064525 | | 6/2007 |
| WO | WO 2007101470 | | 9/2007 |
| WO | WO 2010086821 | A2 | 8/2010 |

OTHER PUBLICATIONS

Bergervoet, P.W.M., et al., "Application of the forensic Luminol for blood in infection control," Elsevier, Journal of Hospital Infection (2008) 68, pp. 329-333.

Carling, Philip C., et al., "Improved Cleaning of Patient Rooms Using a New Targeting Method," Brief Report, CID 2006:42 (Feb. 1), pp. 385-388, Feb. 1, 2006.

Charoensaeng, Ampira, et al, "Solubilization and Adsolubilization of Polar and Nonpolar Organic Solutes by Linker Molecules and Extended Surfactants," Springer AOCS, J. Surfact. Deterg. (2009) 12, pp. 209-217.

Do, Linh D., et al., "Environmentally Friendly Vegetable Oil Microemulsions Using Extended Surfactants and Linkers," Springer AOCS, J. Surfact. Deterg. (2009) 12, pp. 91-99.

Griffith, C.J., et al. "An evaluation of hospital cleaning regimes and standards," The Hospital Infection Society, Journal of Hospital Infection (2000) 45, pp. 19-28.

Hartel, Peter G., et al., "Exposing water samples to ultraviolet light improves fluorometry for detecting human fecal contamination," Elsevier, Water Research (2007) pp. 3629-3642.

Lipscomb, I.P., et al., "Rapid method for the sensitive detection of protein contamination on surgical instruments," Elsevier, Journal of Hospital Infection (2006) 62, pp. 141-148.

Lu, Y.F., et al., "Laser surface cleaning and real-time monitoring," ALT '99 International Conference on Advanced Laser Technologies, SPIE vol. 4070 (2000), pp. 331-337.

Mori, F., et al., "Equilibrium and dynamic behavior of a system containing a mixture of anionic and nonionic surfactants," Progress in Colloid & Polymer Science (1990) 82, pp. 114-121.

Phan, Tri T., et al., "Microemulsion-Based Vegetable Oil Detergency Using an Extended Surfactant," Springer AOCS, J. Surfact. Deterg (2010) 13, pp. 313-319.

Pyrek, Kelly M., "Hospitals Can Learn from CSI Sleuthing Methods," Virgo Publishing (2011), posted on Jun. 9, 2008 at website: http://www.infectioncontroltoday.com/.

Salo, Satu, et al., "Cleaning validation of fermentation tanks," Elsevier, Food and Bioproducts Processing 86 (2008) pp. 204-210.

Wisniewski, Karen, "Specialty Liquid Household Surface Cleaners," Research & Development, Global Technology, Colgate-Palmolive Company, pp. 463-512.

Witthayapanyanon, Anuradee, et al., "Interfacial Properties of Extended-Surfactant-Based Microemulsions and Related Macroemulsions," Springer AOCS, J. Surfact. Deterg. (2010) 13, pp. 127-134.

Zhang, Hui, et al., "Lauryl Alcohol and Amine Oxide as Foam Stabilizers in the Presence of Hardness and Oily Soil," Journal of Surfactants and Detergents, vol. 8, No. 1 (Jan. 2005), pp. 99-107.

Website of "Cleanser alcohol hand rub training gel Fluroescent gel 500m1 bottle with integral pump dispenser," [retrieved on Mar. 25, 2011], retrieved from the internet: https://my.supplychain.nhs.uk/catalogue/product/mrb180/cleanser-alcohol-hand-rub-training-gel.

International Search Report, Ecolab, Inc., PCT/US2010/049319, mailed Jun. 1, 2011.

International Search Report, Ecolab, Inc., PCT/US2010/049326, mailed Jun. 1, 2011.

International Search Report, Ecolab, Inc., PCT/US2010/049334, mailed Jun. 21, 2011.

International Search Report, Ecolab, Inc., PCT/US2010/049338, mailed Jun. 28, 2011.

* cited by examiner

CLEANING COMPOSITIONS EMPLOYING EXTENDED CHAIN ANIONIC SURFACTANTS

CROSS-REFERENCE TO RELATED APPLICATIONS

This application is a Continuation Application of Ser. No. 13/895,696 filed May 16, 2013, now abandoned, which is a Continuation Application of Ser. No. 13/535,508 filed Jun. 28, 2012 now issued U.S. Pat. No. 8,454,709 on Jun. 4, 2013, which is a Continuation Application of Ser. No. 12/884,608 filed Sep. 17, 2010, now issued U.S. Pat. No. 8,246,696 on Aug. 21, 2012, all of which are incorporated by reference in their entirety.

FIELD OF THE INVENTION

The invention relates to detergent and cleaning compositions which employ synergistic combinations of components including extended chain anionic surfactants. The detergent compositions are useful for removing a number of challenging stains including non-trans fats and fatty acids by forming emulsions with such oily and greasy soils for their removal.

BACKGROUND OF THE INVENTION

Surfactants reduce the surface tension of water by adsorbing at the liquid-gas interface. They also reduce the interfacial tension between oil and water by adsorbing at the liquid-liquid interface. Surfactants are a primary component of most detergents. When dissolved in water, surfactants give a product the ability to remove soil from surfaces. Each surfactant molecule has a hydrophilic head that is attracted to water molecules and a hydrophobic tail that repels water and simultaneously attaches itself to oil and grease in soil. These opposing forces loosen the soil and suspend it in the water.

Surfactants do the basic work of detergents and cleaning compositions by breaking up stains and keeping the soil in the water solution to prevent re-deposition of the soil onto the surface from which it has just been removed. Surfactants disperse soil that normally does not dissolve in water.

Nonylphenol ethoxylates (NPEs) are predominantly used as industrial and domestic detergents as a surfactant. However, while effective, NPEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods.

An alternative to NPEs are alcohol ethoxylates (AEs). These alternatives are less toxic and degrade more quickly in the environment. However, it has recently been found that textiles washed with NPE free and phosphorous free detergents containing AEs smoke when exposed to high heat, e.g., in a steam tunnel in industrial laundry processes, or when ironed. Surfactant is often incorporated into an oil-in-water microemulsion to make the products appear more homogenous. These cleaning products contain a variety of different surfactant systems in 5-20% solubilized oil which are then diluted with water prior to use. The surfactant systems generally employed in these cleaning products include a mixture of anionic or non-ionic surfactants and a short chain alcohol to help solubilize the oil phase and prevent liquid crystal formation. While short chain alcohols are effective, they also contribute to the volatile organic solvent content (VOC) of the product and pose flammability problems.

As can be seen there is a continuing need to develop effective, environmentally friendly, and safe surfactants and surfactant systems that can be used in cleaners of all kinds. This is particularly so in light of several new cleaning challenges that have emerged.

Health authorities have recently recommended that trans fats be reduced or eliminated in diets because they present health risks. In response, the food industry has largely replaced the use of trans fats with non-trans fats. These types of non-trans fats are the most difficult to remove from surfaces because; 1) the high molecular weight of triglyceride oil results in more difficulty in forming either dispersions or bicontinuous structures, 2) the polyunsaturation of triglyceride oil makes it difficult to be handled by conventional surfactants, and 3) polymerization of the triglyceride oil makes it even more difficult to remove. The food industry has also experienced an unexplained higher frequency of laundry fires. Non-transfats, are prone to cause fire due their substantial heat of polymerization. Non-transfats have conjugated double bonds that can polymerize and the substantial heat of polymerization involved can cause fire, for example, in a pile of rags used to mop up these non-transfat soils.

As can be seen, there is a need in the industry for improvement of cleaning compositions, such as hard surface and laundry detergents and particularly the surfactants used therein so that difficult soils can be removed in a safe environmentally friendly and effective manner.

SUMMARY OF THE INVENTION

The invention meets the needs above by providing a surfactant system, mixture or blend that can be used alone or as a part of a laundry detergent, hard surface cleaner or a prespotting treatment. The surfactant system is capable of forming emulsions with, and thus removing, oily and greasy stains. In a preferred embodiment the surfactant compositions of the invention can remove non-transfat and fatty acid stains. Generally, non-transfats are more difficult to remove than transfats both from a cleaning and removal standpoint as well as laundry safety concern due to heat of polymerization of the non-trans fats. The invention is highly effective for removal of transfats, and other oily soils.

The invention has many uses and applications which include but are not limited to: laundry cleaning, reduction of laundry fire due to non-transfats, and hard surface cleaning such as manual pot-n-pan cleaning, machine warewashing, all purpose cleaning, floor cleaning, CIP cleaning, open facility cleaning, foam cleaning, vehicle cleaning, etc. The invention is also relevant to non-cleaning related uses and applications such as dry lubes, tire dressings, polishes, etc. as well as triglyceride based lotions, suntan lotions, potentially pharmaceutical emulsions and microemulsions.

The surfactant system comprises a synergistic combination of components with an extended chain anionic surfactant. In one such embodiment an extended chain anionic surfactant is combined with a linker surfactant. The linker can be a single hydrophobic tail with hydrophilic head of small effectively hydrated radius such as amine oxides, fatty acids, mono glyceride, potentially long chain alcohol or a twin hydrophobic tails with hydrophilic head of "regular or large" effectively hydrated radius di-octyl sulfosuccinate, diglyceride). The invention also includes a and a multiply charged cation such as $Mg^{2+}$, $Ca^{2+}$ or other functional electrolyte such as a alkalinity source or a chelating agent. The resultant combination is highly effective at forming microemulsions with non-transfats at relatively low temperatures. This system can be used in formulations for laundry detergents, hard surface cleaners, whether alkali or acid based, or even by itself as a pre-spotting agent.

In a further aspect of the present invention, a laundry detergent composition is provided which includes the surfactant system of the invention, a builder and an enzyme; the laundry detergent product being adapted to readily dissolve and disperse non trans fats in commercial, industrial and personal laundry washing processes or in a pre-spotting treatment. These and other objects, features and attendant advantages of the present invention will become apparent to those skilled in the art from a reading of the following detailed description of the preferred embodiment and the appended claims.

DETAILED DESCRIPTION OF THE INVENTION

Figure 1:
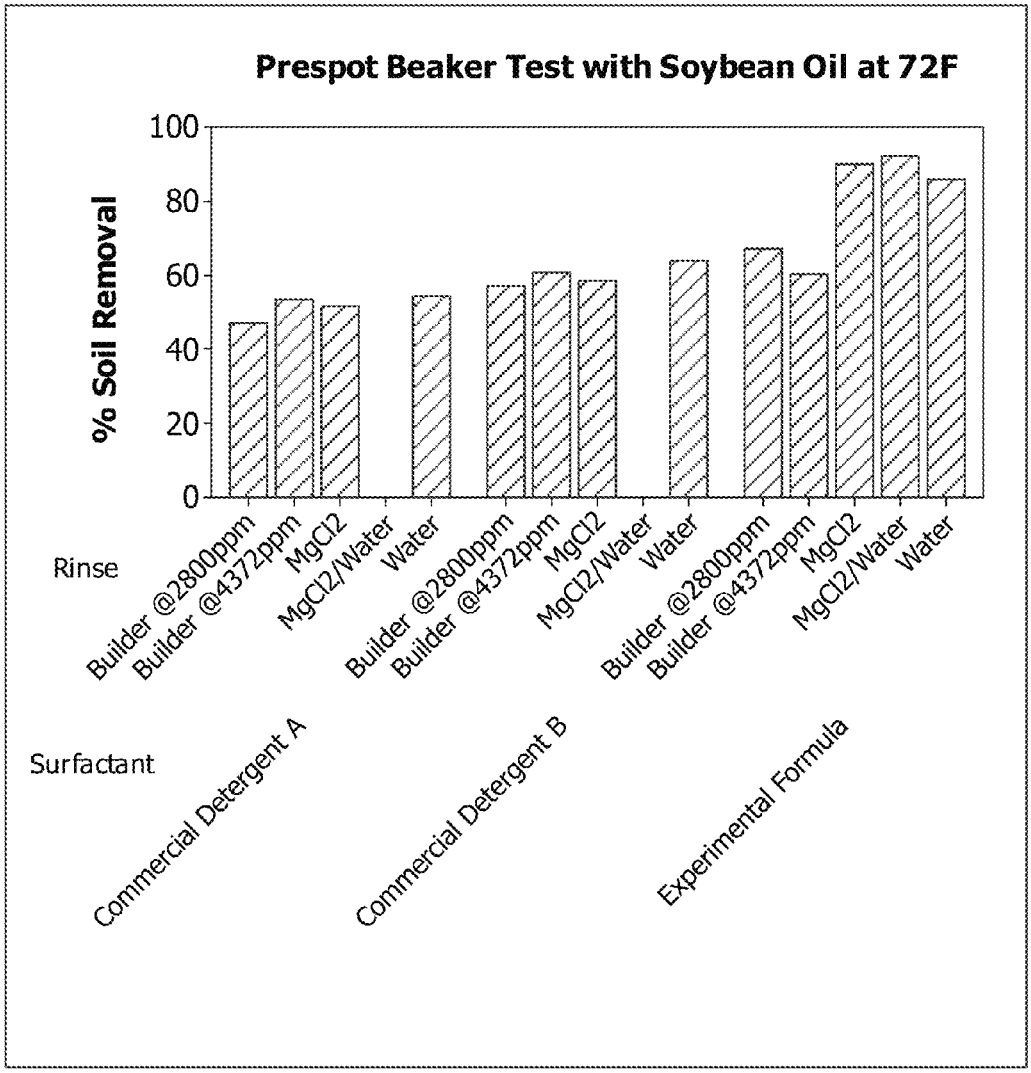
FIG. 1 is a graph of the percent soil removal in a prespot beaker test with soybean oil at 72° F. with water, 5.6% $MgCl_2$ (30%), Builder at equal conductivity, and Builder at the recommended use level.

So that the invention maybe more readily understood, certain terms are first defined and certain test methods are described.

As used herein, "weight percent," "wt-%", "percent by weight", "% by weight", and variations thereof refer to the concentration of a substance as the weight of that substance divided by the total weight of the composition and multiplied by 100. It is understood that, as used here, "percent", "%", and the like are intended to be synonymous with "weight percent", "wt-%", etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "surfactant" as used herein is a compound that contains a lipophilic segment and a hydrophilic segment, which when added to water or solvents, reduces the surface tension of the system.

An "extended chain surfactant" is a surfactant having an intermediate polarity linking chain, such as a block of polypropylene oxide, or a block of poly-ethylene oxide, or a block of poly-butylene or a mixture thereof, inserted between the surfactant's conventional lipophilic segment and hydrophilic segment.

The term "electrolyte" refers to a substance that will provide ionic conductivity when dissolved in water or when in contact with it; such compounds may either be solid or liquid.

As used herein, the term "microemulsion" refers to thermodynamically stable, isotropic dispersions consisting of nanometer size domains of water and/or oil stabilized by an interfacial film of surface active agent characterized by ultra low interfacial tension.

It should be noted that, as used in this specification and the appended claims, the singular forms "a", "an", and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

As used herein, the term "cleaning" refers to a method used to facilitate or aid in soil removal, bleaching, microbial population reduction, and any combination thereof.

"Soil" or "stain" refers to a non-polar oily substance which may or may not contain particulate matter such as mineral clays, sand, natural mineral matter, carbon black, graphite, kaolin, environmental dust, etc.

As used herein, the term "cleaning composition" includes, unless otherwise indicated, detergent compositions, laundry cleaning compositions, hard surface cleaning compositions, and personal care cleaning compositions for use in the health and beauty area. Cleaning compositions include granular, powder, liquid, gel, paste, bar form and/or flake type cleaning agents, laundry detergent cleaning agents, laundry soak or spray treatments, fabric treatment compositions, dish washing detergents and soaps, shampoos, body washes and soaps, and other similar cleaning compositions. As used herein, the term "fabric treatment composition" includes, unless otherwise indicated, fabric softening compositions, fabric enhancing compositions, fabric freshening compositions and combinations there of. Such compositions may be, but need not be rinse added compositions.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated.

Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

Surfactant Systems Employing Extended Chain Anionic Surfactants

The surfactant system or mixture of the invention employs one or more extended chain surfactants. These are surfactants that have, for example, an intermediate polarity poly-propylene oxide chain (or linker) inserted between the lipophilic tail group and hydrophilic polar head, which may be anionic or nonionic.

Examples of lipophilic tails groups include hydrocarbons, alkyl ether, fluorocarbons or siloxanes. Examples of anionic and nonionic hydrophilic polar heads of the extended surfactant include, but are not necessarily limited to, groups such as polyoxyethylene sulfate, ethoxysulfate, carboxylate, ethoxy-carboxylate, C6 sugar, xylitol, di-xylitol, ethoxy-xylitol, carboxylate and xytol, carboxylate and glucose.

an alkali metal, alkaline earth metal, ammonium and ammonium ions which may be substituted with one or more organic groups.

These extended chain surfactants attain low interfacial tension and/or high solubilization in a single phase microemulsion with oils, such as nontrans fats with additional beneficial properties including, but not necessarily limited to, insensitivity to temperature and irreversibility. For example, in one embodiment the emulsions may function over a relatively wide temperature range of from about 20 to about 280° C., alternatively from about 20 to about 180° C. (350° F.).

Many extended chain anionic and nonionic surfactants are commercially available from a number of sources. Table 1 is a representative, nonlimiting listing of several examples of the same.

TABLE 1

| Extended Surfactants | Source | % Active | Structure |
|---|---|---|---|
| Plurafac SL-42 (nonionic) | BASF | 100 | $C_{6-10}$-$(PO)_3(EO)_6$ |
| Plurafac SL-62 (nonionic) | BASF | 100 | $C_{6-10}$-$(PO)_3(EO)_8$ |
| Lutensol XL-40 (nonionic) | BASF | 100 | $C_{10}$-$(PO)_a(EO)_b$ series, where a |
| Lutensol XL-50 (nonionic) | BASF | 100 | is 1.0 to 1.5, and b is 4 to 14. |
| Lutensol XL-60 (nonionic) | BASF | 100 | |
| Lutensol XL-70 (nonionic) | BASF | 100 | |
| Lutensol XL-79 (nonionic) | BASF | 85 | |
| Lutensol XL-80 (nonionic) | BASF | 100 | |
| Lutensol XL-89 (nonionic) | BASF | 80 | |
| Lutensol XL-90 (nonionic) | BASF | 100 | |
| Lutensol XL-99 (nonionic) | BASF | 80 | |
| Lutensol XL-100 (nonionic) | BASF | 100 | |
| Lutensol XL-140 (nonionic) | BASF | 100 | |
| Ecosurf EH-3 (nonionic) | Dow | 100 | 2-Ethyl Hexyl $(PO)_m(EO)_n$ series |
| Ecosurf EH-6 (nonionic) | Dow | 100 | |
| Ecosurf EH-9 (nonionic) | Dow | 100 | |
| Ecosurf SA-4 (nonionic) | Dow | 100 | $C_{6-12}$ $(PO)_{3-4}$ $(EO)_4$ |
| Ecosurf SA-7 (nonionic) | Dow | 100 | $C_{6-12}$ $(PO)_{3-4}$ $(EO)_7$ |
| Ecosurf SA-9 (nonionic) | Dow | 100 | $C_{6-12}$ $(PO)_{3-4}$ $(EO)_9$ |
| Surfonic PEA-25 (nonionic) | Huntsman | 100 | $C_{12-14}(PO)_2N[(EO)_{2.5}\}_2$ |
| X-AES (anionic) | Huntsman | 23 | $C_{12-14}$-$(PO)_{16}$-$(EO)_2$-sulfate |
| X-LAE (nonionic) | Huntsman | 100 | $C_{12-14}$-$(PO)_{16}(EO)_{12}$ |
| Alfoterra 123-4S (anionic) | Sasol | 30 | $C_{12-13}$-$(PO)_4$-sulfate |
| Alfoterra 123-8S (anionic) | Sasol | 30 | $C_{12-13}$-$(PO)_8$-sulfate |
| Marlowet 4561 (nonionic under acidic condition, anionic under alkaline condition) | Sasol | 90 | $C_{16-18}(PO)_4(EO)_5$-carboxylic acid |
| Marlowet 4560 (nonionic under acidic condition, anionic under alkaline condition) | Sasol | 90 | $C_{16-18}(PO)_4(EO)_2$-carboxylic acid |
| Marlowet 4539 (nonionic under acidic condition, anionic under alkaline condition) | Sasol | 90 | Iso $C_9$-$(PO)_2EO_2$-carboxylic acid |

Extended surfactants include a linker polypropylene glycol link. The general formula for a nonionic extended surfactant is $R\text{-}[L]_x[O—CH_2—CH_2]_y$, Where R is the lipophilic moiety, a linear or branched, saturated or unsaturated, substituted or unsubstituted, aliphatic or aromatic hydrocarbon radical having from about 8 to 20 carbon atoms, L is a linking group, such as a block of poly-propylene oxide, a block of poly-ethylene oxide, a block of poly-butylene oxide or a mixture thereof; x is the chain length of the linking group ranging from 5-15; and y is the average degree of ethoxylation ranging from 1-5. Anionic extended surfactants generally have the formula $$R\text{-}[L]_x—[O—CH_2—CH_2]_y\text{-}M$$

Where M is any ionic species such as carboxylates, sulfonates, sulfates, and phosphates. A cationic species will generally also be present for charge neutrality such as hydrogen, According to the invention, an anionic extended chain surfactant is employed in synergistic combination with a linker such as amine oxide or dioctyl sulfosuccinate or a linker cosurfactant such as monoglycerides, diglycerides, fatty acids or fatty diacids The linker is an additive which "sticks to" or "associates with" the extended chain anionic surfactant and links it with the molecules in the bulk phase, and hence increase the "reach" of the surfactant molecules which are adsorbed at interface, thus enhancing their performance. The choice among the different linkers includes considerations involving foam, pH, the type of surface to be cleaned, the cleaning temperature and the like. For example, under acid or alkaline conditions, the dioctyl suflosuccinate can rapidly degrade while amine oxide does not. The linker can be a single hydrophobic tail with hydrophilic head of small effectively hydrated radius such as amine oxides, fatty acids, mono glyceride, potentially long chain alcohol or a twin hydrophobic tails with hydrophilic head of "regular or large" effectively hydrated radius di-octyl sulfosuccinate, diglyceride).

The surfactant system further comprises a multiply charged cation such as $Mg^{2+}$, $Ca^{2+}$ and/or functional electrolytes such as an alkalinity source or one of more chelating agents.

The surfactant system of the invention is particularly suited for removal of most greasy and oily soils including the most difficult types of soils, non-transfats. This removal is accomplished without the need for additional surfactants or alcohol components which can lead to high VOC content. See for example USPTO Patent Application 2006/0211593, ENHANCED SOLUBILIZATION USING EXTENDED CHAIN SURFACTANTS, which describes a system for removal of general soils in which a blend comprising an extended chain nonionic surfactant is mixed with a second surfactant with a high hydrophilic/lipophilic balance index, (HLB) i.e. a surfactant that is more hydrophilic and less lipophilic in character. Examples of such high HLB surfactants are listed as high alkoxylated $C_{8-20}$ alcohols and alkyl phenols. The alkoxylated alcohols may be ethoxylated alcohols, propoxylated alcohols and/or a mixture of ethoxylated/propoxylated alcohols. Contrary to the preceding, applicants have found a synergistic combination of components which improve the cleaning performance without the need for excess surfactants.

Some representative compositions of this invention are shown in the table below:

| Item | Raw Material | RM Code | WT % | WT % | WT % | WT % | WT % |
|---|---|---|---|---|---|---|---|
| 1 | DI Water | | 16.98 | 55.69 | 75.04 | 84.72 | 89.55 |
| 2 | X-AES, 23% | Huntsman | 57.42 | 28.71 | 14.36 | 7.18 | 3.59 |
| 3 | C12 AO, 30% | 172452 | 20.00 | 10.00 | 5.00 | 2.50 | 1.25 |
| 4 | MgCl2, 30% | 142000 | 5.60 | 5.60 | 5.60 | 5.60 | 5.60 |
| | | Total | 100.00 | 100.00 | 100.00 | 100.00 | 99.99 |
| | Total active surfactants | | 19.21 | 9.60 | 4.80 | 2.40 | 1.20 |
| | Targeted non-transfat level | | 19.21 | 9.60 | 4.80 | 2.40 | 1.20 |

The compositions listed are different strengths (concentrations) except for a constant optimal $Mg^{2+}$ concentration. The choice of concentration is dependent on the level of soiling desired to be cleaned. The formulations of the invention work well on any type of greasy or oily soil and also work on the most difficult type of soil to remove, non-trans fat soils.

At a standard ratio of the anionic extended chain surfactant to the multiply charged cation can be from 1:0.01 to 1:5.31 and the ratio of the anionic extended chain surfactant to the linker can be from 1:0.167 to 1:2.33.

In a preferred embodiment the ratio of the anionic extended chain surfactant to the multiply charged cation can be from 1:0.01 to 1:3.0 and the ratio of the anionic extended chain surfactant to the linker can be from 1:0.10 to 1:1.50.

In a most preferred embodiment the ratio of the anionic extended chain surfactant to the multiply charged cation can be from 1:0.01 to 1:2.50 and the ratio of the anionic extended chain surfactant to the linker can be from 1:0.30 to 1:1.0.

The amounts of the components are not critical and can be adjusted to maximize the planar surface and adjusted for the desired soils to be cleaned. While not wising to be bound by any theory, applicants postulate that the beneficial use of surfactants with a balanced cross-sectional area, for example surfactants with a small hydrophilic head and/or surfactants with twin or bulky hydrophobic tail(s) help the overall packing at the water and oil interface towards a more planar interface. Other possible linkers with balanced cross sectional areas include branched alcohol ethoxylates and Guerbet alcohol ethoxylates. The multiple charge cations, especially $Mg^{2+}$, compress the effective sizes of the hydrophilic head, further helping the overall packing towards a planar interface. Alternatively, alkalinity may be used for this purpose as explained herein. Alkalinity provides other benefits such as dissolving polymerized grease.

Cleaning Compositions Comprising Extended Chain Surfactants

The surfactant system of the invention may be used alone, as a pre-spot or pre-treatment composition in combination with a traditional detergent or cleaner, or may be incorporated within a cleaning composition. The invention comprises both hard surface and soft surface cleaning compositions employing the disclosed surfactant system.

In one embodiment, the invention employs the surfactant system of the invention, an acid source, a solvent, a water conditioning agent, and water to make a hard surface cleaner which will be effective at removing greasy and oily soils from surfaces such as showers, sinks, toilets, bathtubs, countertops, windows, mirrors, transportation vehicles, floors, and the like. These surfaces can be those typified as "hard surfaces" (such as walls, floors, bed-pans).

A typical hard surface formulation at about 18% activity includes between about 40 wt. % and about 80 wt. % surfactant system of the invention, between about 3 wt. % and about 18 wt. % water conditioning agent, between about 0.1 wt. % and about 0.55 wt. % acid source, between about 0 wt % and about 10 wt. % solvent and between about 10 wt. % and about 60 wt. % water.

Particularly, the cleaning compositions include between about 45 wt. % and about 75 wt. % surfactant system of the invention, between about 0 wt. % and about 10 wt. % optional co-surfactant, between about 5 wt. % and about 15 wt. % water conditioning agent, between about 0.3 wt. % and about 0.5 wt. % acid source, between about 0 and about 6 wt. % solvent and between about 15 wt. % and about 50 wt. % water. In other embodiments, similar intermediate concentrations and use concentrations may also be present in the cleaning compositions of the invention.

In a laundry detergent formulation the compositions of the invention typically include the surfactant system of the invention, and a builder, optionally with an enzyme. Examples of such standard laundry detergent ingredients, which are well known to those skilled in the art, are provided in the following paragraphs.

Additional Components

While not essential for the purposes of the present invention, the non-limiting list of additional components illustrated hereinafter are suitable for use in the instant compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the cleaning operation for which it is to be used. Suitable additional materials include, but are not limited to, surfactants, builders, chelating agents, dye transfer inhibiting agents, viscosity modifiers, dispersants, additional enzymes, and enzyme stabilizers, catalytic materials, bleaches, bleach activators, hydrogen peroxide, sources of hydrogen peroxide, preformed peracids, polymeric dispersing agents, threshold inhibitors for hard water precipitation pigments, clay soil removal/anti-redeposition agents, brighteners, suds suppressors, dyes, fabric hueing agents, perfumes, structure elasticizing agents, fabric softeners, carriers, hydrotropes, processing aids, solvents, pigments antimicrobials, pH buffers, processing aids, active fluorescent whitening ingredient, additional surfactants and mixtures thereof. In addition to the disclosure below, suitable examples of such other adjuncts and levels of use are found in U.S. Pat. Nos. 5,576,282, 6,306,812 B1 and 6,326,348 B1 that are incorporated by reference.

As stated, the adjunct ingredients are not essential to Applicants' compositions. Thus, certain embodiments of Applicants' compositions do not contain additional materials. However, when one or more additional materials are present, such one or more additional components may be present as detailed below:

The liquid detergent herein has a neat pH of from about 7 to about 13, or about 7 to about 9, or from about 7.2 to about 8.5, or from about 7.4 to about 8.2. The detergent may contain a buffer and/or a pH-adjusting agent, including inorganic and/or organic alkalinity sources and acidifying agents such as water-soluble alkali metal, and/or alkali earth metal salts of hydroxides, oxides, carbonates, bicarbonates, borates, silicates, phosphates, and/or metasilicates; or sodium hydroxide, potassium hydroxide, pyrophosphate, orthophosphate, polyphosphate, and/or phosphonate. The organic alkalinity source herein includes a primary, secondary, and/or tertiary amine. The inorganic acidifying agent herein includes HF, HCl, HBr, HI, boric acid, sulfuric acid, phosphoric acid, and/or sulphonic acid; or boric acid. The organic acidifying agent herein includes substituted and substituted, branched, linear and/or cyclic $C_{1-30}$ carboxylic acid.

Bleaching Agents—The cleaning compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition. Examples of suitable bleaching agents include: (1) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxzone®, and mixtures thereof. Suitable percarboxylic acids include hydrophobic and hydrophilic peracids having the formula R—(C—O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen; (2) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (3) bleach activators having R—(C—O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject cleaning composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

Additional Surfactant

In some embodiments, the compositions of the invention include an additional surfactant. Additional surfactants can be anionic, nonionic, cationic zwitterionic and can also include additional extended chain surfactant as discussed herein.

The cleaning composition can contain an additional anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the additional anionic surfactant component in an amount sufficient to provide a use composition having desired wetting and detersive properties after dilution with water. The concentrate can contain about 0.1 wt. % to about 0.5 wt. %, about 0.1 wt. % to about 1.0 wt. %, about 1.0 wt. % to about 5 wt. %, about 5 wt. % to about 10 wt. %, about 10 wt. % to about 20 wt. %, 30 wt. %, about 0.5 wt. % to about 25 wt. %, and about 1 wt. % to about 15 wt. %, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Additional nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Other nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the detergent composition concentrate, they can be included in an amount of at least about 0.1 wt. % and can be included in an amount of up to about 15 wt. %. The concentrate can include about 0.1 to 1.0 wt. %, about 0.5 wt. % to about 12 wt. % or about 2 wt. % to about 10 wt. % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning composition can contain a cationic surfactant component that includes a detersive amount of cationic surfactant or a mixture of cationic surfactants. Cationic co-surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$) dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Builders—The cleaning compositions of the present invention may comprise one or more detergent builders or builder systems. When a builder is used, the subject composition will typically comprise at least about 1%, from about 5% to about 60% or even from about 10% to about 40% builder by weight of the subject composition. The detergent may contain an inorganic or organic detergent builder which counteracts the effects of calcium, or other ion, water hardness. Examples include the alkali metal citrates, succinates, malonates, carboxymethyl succinates, carboxylates, polycarboxylates and polyacetyl carboxylate; or sodium, potassium and lithium salts of oxydisuccinic acid, mellitic acid, benzene polycarboxylic acids, and citric acid; or citric acid and citrate salts. Organic phosphonate type sequestering agents such as DEQUEST® by Monsanto and alkanehydroxy phosphonates are useful. Other organic builders include higher molecular weight polymers and copolymers, e.g., polyacrylic acid, polymaleic acid, and polyacrylic/polymaleic acid copolymers and their salts, such as SOKALAN® by BASF. Generally, the builder may be up to 30%, or from about 1% to about 20%, or from abut 3% to about 10%.

The compositions may also contain from about 0.01% to about 10%, or from about 2% to about 7%, or from about 3% to about 5% of a $C_{8-20}$ fatty acid as a builder. The fatty acid can also contain from about 1 to about 10 EO units. Suitable fatty acids are saturated and/or unsaturated and can be obtained from natural sources such a plant or animal esters (e.g., palm kernel oil, palm oil, coconut oil, babassu oil, safflower oil, tall oil, tallow and fish oils, grease, and mixtures thereof), or synthetically prepared (e.g., via the oxidation of petroleum or by hydrogenation of carbon monoxide via the Fisher Tropsch process). Useful fatty acids are saturated $C_{12}$ fatty acid, saturated $C_{12-14}$ fatty acids, saturated or unsaturated $C_{12-18}$ fatty acids, and a mixture thereof. Examples of suitable saturated fatty acids include captic, lauric, myristic, palmitic, stearic, arachidic and behenic acid. Suitable unsaturated fatty acids include: palmitoleic, oleic, linoleic, linolenic and ricinoleic acid.

Chelating Agents—The cleaning compositions herein may contain a chelating agent. Suitable chelating agents include copper, iron and/or manganese chelating agents and mixtures thereof. When a chelating agent is used, the subject composition may comprise from about 0.005% to about 15% or even from about 3.0% to about 10% chelating agent by weight of the subject composition.

Dye Transfer Inhibiting Agents—The cleaning compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

Optical Brightener

In some embodiments, an optical brightener component, may be present in the compositions of the present invention. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal UNPA, which is commercially available through the Ciba Geigy Corporation located in Switzerland.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include lower levels of from about 0.01, from about 0.05, from about 0.1 or even from about 0.2 wt % to upper levels of 0.5 or even 0.75 wt %.

Dispersants—The compositions of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Additional Enzymes—The cleaning compositions can comprise one or more enzymes which provide cleaning performance and/or fabric care benefits. Enzymes can be included herein for a wide variety of fabric laundering purposes, including removal of protein-based, carbohydrate-based, or triglyceride-based stains, for example, and/or for fabric restoration. Examples of suitable enzymes include, but are not limited to, hemicellulases, peroxidases, proteases, cellulases, xylanases, lipases, phospholipases, esterases, cutinases, pectinases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, or combinations thereof and may be of any suitable origin. The choice of enzyme(s) takes into account factors such as pH-activity, stability optima, thermostability, stability versus active detergents, chelants, builders, etc. A detersive enzyme mixture useful herein is a protease, lipase, cutinase and/or cellulase in conjunction with amylase. Sample detersive enzymes are described in U.S. Pat. No. 6,579,839.

Enzymes are normally present at up to about 5 mg, more typically from about 0.01 mg to about 3 mg by weight of active enzyme per gram of the detergent. Stated another way, the detergent herein will typically contain from about 0.001% to about 5%, or from about 0.01% to about 2%, or from about 0.05% to about 1% by weight of a commercial enzyme preparation. Protease enzymes are present at from about 0.005 to about 0.1 AU of activity per gram of detergent. Proteases useful herein include those like subtilisins from *Bacillus* [e.g. subtilis, lentus, lichenifonnis, amyloliquefaciens (BPN, BPN'), alcalophilus,] e.g. Esperase®, Alcalase®, Everlase® and Savinase® (Novozymes), BLAP and variants (Henkel). Further proteases are described in EP 130756, WO 91/06637, WO 95/10591 and WO 99/20726.

Amylases are described in GB Pat. #1 296 839, WO 94/02597 and WO 96/23873; and available as Purafect Ox Am® (Genencor), Termamyl®, Natalase®, Ban®, Fungamyl®, Duramyl® (all Novozymes), and RAPIDASE (International Bio-Synthetics, Inc).

The cellulase herein includes bacterial and/or fungal cellulases with a pH optimum between 5 and 9.5. Suitable cellulases are disclosed in U.S. Pat. No. 4,435,307 to Barbesgoard, et al., issued Mar. 6, 1984. Cellulases useful herein include bacterial or fungal cellulases, e.g. produced by *Humicola insolens*, particularly DSM 1800, e.g. 50 kD and ~43 kD (Carezyyme®). Additional suitable cellulases are the EGIII cellulases from *Trichoderma longibrachiatum*. WO 02/099091 by Novozymes describes an enzyme exhibiting endo-beta-glucanase activity (EC 3.2.1.4) endogenous to *Bacillus* sp., DSM 12648; for use in detergent and textile applications; and an anti-redeposition endo-glucanase in WO 04/053039. Kao's EP 265 832 describes alkaline cellulase K, CMCase I and CMCase II isolated from a culture product of *Bacillus* sp KSM-635. Kao further describes in EP 1 350 843 (KSM 5237; 1139; KSM 64; KSM N131), EP 265 832A (KSM 635, FERM BP 1485) and EP 0 271 044 A (KSM 534, FERM BP 1508; KSM 539, FERM BP 1509; KSM 577, FERM BP 1510; KSM 521, FERM BP 1507; KSM 580, FERM BP 1511; KSM 588, FERM BP 1513; KSM 597, FERM BP 1514; KSM 522, FERM BP 1512; KSM 3445, FERM BP 1506; KSM 425. FERM BP 1505) readily-mass producible and high activity alkaline cellulases/endo-glucanases for an alkaline environment. Such endo-glucanase may contain a polypeptide (or variant thereof) endogenous to one of the above *Bacillus* species. Other suitable cellulases are Family 44 Glycosyl Hydrolase enzymes exhibiting endo-beta-1,4-glucanase activity from Paenibacilus polyxyma (wild-type) such as XYG1006 described in WO 01/062903 or variants thereof. Carbohydrases useful herein include e.g. mannanase (see, e.g., U.S. Pat. No. 6,060,299), pectate lyase (see, e.g., WO99/27083), cyclomaltodextrin glucanotransferase (see, e.g., WO96/33267), and/or xyloglucanase (see, e.g., WO99/02663). Bleaching enzymes useful herein with enhancers include e.g. peroxidases, laccases, oxygenases, lipoxygenase (see, e.g., WO 95/26393), and/or (non-heme) haloperoxidases.

Suitable endoglucanases include: 1) An enzyme exhibiting endo-beta-1,4-glucanase activity (E.C. 3.2.1.4), with a sequence at least 90%, or at least 94%, or at least 97% or at least 99%, or 100% identity to the amino acid sequence of positions 1-773 of SEQ ID NO:2 in WO 02/099091; or a fragment thereof that has endo-beta-1,4-glucanase activity. GAP in the GCG program determines identity using a GAP creation penalty of 3.0 and GAP extension penalty of 0.1. See WO 02/099091 by Novozymes A/S on Dec. 12, 2002, e.g., Celluclean™ by Novozymes A/S. GCG refers to sequence analysis software package (Accelrys, San Diego, Calif., USA). GCG includes a program called GAP which uses the Needleman and Wunsch algorithm to find the alignment of two complete sequences that maximizes the number of matches and minimizes the number of gaps; and 2) Alkaline endoglucanase enzymes described in EP 1 350 843A published by Kao on Oct. 8, 2003 ([0011]-[0039] and examples 1-4).

Suitable lipases include those produced by *Pseudomonas* and *Chromobacter*, and LIPOLASE®, LIPOLASE ULTRA®, LIPOPRIME® and LIPEX® from Novozymes. See also Japanese Patent Application 53-20487, laid open on Feb. 24, 1978, available from Areario Pharmaceutical Co. Ltd., Nagoya, Japan, under the trade name Lipase P "Amano". Other commercial lipases include Amano-CES, lipases ex *Chromobacter viscosum*, available from Toyo Jozo Co., Tagata, Japan; and *Chromobacter viscosum* lipases from U.S. Biochemical Corp., U.S.A. and Diosynth Co., The Netherlands, and lipases ex *Pseudomonas gladioli*. Also suitable are cutinases [EC 3.1150] and esterases.

Enzymes useful for liquid detergent formulations, and their incorporation into such formulations, are disclosed in U.S. Pat. No. 4,261,868 to Hora, et al., issued Apr. 14, 1981. In an embodiment, the liquid composition herein is substantially free of (i.e. contains no measurable amount of) wild-type protease enzymes. A typical combination is an enzyme cocktail that may comprise, for example, a protease and lipase in conjunction with amylase. When present in a cleaning composition, the aforementioned additional enzymes may be present at levels from about 0.00001% to about 2%, from about 0.0001% to about 1% or even from about 0.001% to about 0.5% enzyme protein by weight of the composition.

Enzyme Stabilizers—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability. A useful enzyme stabilizer system is a calcium and/or magnesium compound, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexa methylene biguanide or N,N-bis-3-amino-propyl-dodecyl amine or salt; and mixtures thereof. The detergent may contain a reversible protease inhibitor e.g., peptide or protein type, or a modified subtilisin inhibitor of family VI and the plasminostrepin; leupeptin, peptide trifluoromethyl ketone, or a peptide aldehyde. Enzyme stabilizers are present from about 1 to about 30, or from about 2 to about 20, or from about 5 to about 15, or from about 8 to about 12, millimoles of stabilizer ions per liter.

Catalytic Metal Complexes—Applicants' cleaning compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936 ; 5,595,967. Such cobalt catalysts are readily prepared by known procedures, such as taught for example in U.S. Pat. Nos. 5,597,936, and 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

Solvents—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof. In some embodiments, the solvent includes water. The water can include water from any source including deionized water, tap water, softened water, and combinations thereof. Solvents are typically present at from about 0.1% to about 50%, or from about 0.5% to about 35%, or from about 1% to about 15% by weight.

Form of the Compositions

The detergent compositions of the present invention may be of any suitable form, including paste, liquid, solid (such as tablets, powder/granules), foam or gel, with powders and tablets being preferred. The composition may be in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a moulded casing (such as an injection moulded casing) etc. Preferably the composition is substantially surrounded by such a package, most preferably totally surrounded by such a package. Any such package may contain one or more product formats as referred to herein and the package may contain one or more compartments as desired, for example two, three or four compartments.

If the composition is a foam, a liquid or a gel it is preferably an aqueous composition although any suitable solvent may be used. According to an especially preferred embodiment of the present invention the composition is in the form of a tablet, most especially a tablet made from compressed particulate material.

If the compositions are in the form of a viscous liquid or gel they preferably have a viscosity of at least 50 mPas when measured with a Brookfield RV Viscometer at 25° C. with Spindle 1 at 30 rpm.

The compositions of the invention will typically be used by placing them in a detergent dispenser e.g. in a dishwasher machine draw or free standing dispensing device in an automatic dishwashing machine. However, if the composition is in the form of a foam, liquid or gel then it may be applied to by any additional suitable means into the dishwashing machine, for example by a trigger spray, squeeze bottle or an aerosol.

Processes of Making Cleaning Compositions

The compositions of the invention may be made by any suitable method depending upon their format. Suitable manufacturing methods for detergent compositions are well known in the art, non-limiting examples of which are described in U.S. Pat. Nos. 5,879,584; 5,691,297; 5,574,005; 5,569,645; 5,565,422; 5,516,448; 5,489,392; and 5,486,303. Various techniques for forming detergent compositions in solid forms are also well known in the art, for example, detergent tablets may be made by compacting granular/particular material and may be used herein.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

Reduction of Smoking in Laundry Fabrics

There have been reports of undesirable smoking issues for laundry particularly when a washed fabric comes in contact with a hot iron. This is due to a switch from nonyl phenol ethoxylate (NPE) based detergents to alcohol phenol ethoxylate (APE) based detergents. The problem is due to the residual unreacted long chain alcohols which are highly soluble in APE based detergents. It is well known in the surfactant industry that APEs are more monodisperse and have less unreacted alcohol than the AEs, because the starting alkyl phenols are more reactive than the starting linear alcohols. The use solution cannot suspend all the highly insoluble unreacted alcohol, which deposits onto a washed fabric and can cause smoking when the fabric comes in contact with a hot iron.

The extended surfactants and microemulsions of the present invention undergo two steps of alkoxylation (first propoxylation or butoxylation, then followed with ethoxylation) and therefore have reduced levels of residual (unreacted) alcohol, specifically below 0.1%. Thus after the laundry process, the extended surfactants and microemulsions of the present invention leave less residue from the highly insoluble long chain alcohols onto the washed fabric, which in turn greatly reduces the smoking when these washed fabrics come in contact with hot irons.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. All references cited herein are hereby incorporated in their entirety by reference.

EXAMPLE 1

Synergistic Combinations for Microemulsion Formation

Initial work on this invention had shown a synergistic combination of LS (Lauryl Sulfate) (0.0268 Mole %), LES (Lauryl Ether Sulfate) (0.0147 Mole %), LDAO (Lauryl Dimethylamine Oxide) (0.0131 Mole %), $Mg^{2+}$ (0.0071 Mole %), that lowered the interfacial tension of use solutions vs. corn oil, some to ultra-low range of $10^{-4}$ dynes/cm. Data also showed that most of the interfacial tension lowering is due to LES/AO/$Mg^{2+}$, and that higher levels of $Mg^{2+}$ (for example, 5 times the level stated above, or even higher) provides even lower interfacial tensions. However, high levels of $Mg^{2+}$ also increase gelling, making it difficult to manufacture and dispense.

While not wishing to be bound by any theory, it is surmised that the combination produces surfactant packing that is more planer, and is more prone to form the bi-continuous microemulsions, resulting in ultra-low interfacial tensions at the oil/water interface. The LS and LES are considered anionic surfactants with large hydrophilic heads (with large effective cross-sectional areas), but thin hydrophobic tails (with small cross-sectional areas). However, amine oxide has a small hydrophilic head with more balanced cross-sectional areas and the $Mg^{2+}$ further compress the effective sizes of the hydrophilic heads of the anionic surfactants. The overall result is an overall tighter and planar packing of all the surfactant molecules at the water and oil interface.

Form of the Compositions

The detergent compositions of the present invention may be of any suitable form, including paste, liquid, solid (such as tablets, powder/granules), foam or gel, with powders and tablets being preferred. The composition may be in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a moulded casing (such as an injection moulded casing) etc. Preferably the composition is substantially surrounded by such a package, most preferably totally surrounded by such a package. Any such package may contain one or more product formats as referred to herein and the package may contain one or more compartments as desired, for example two, three or four compartments.

If the composition is a foam, a liquid or a gel it is preferably an aqueous composition although any suitable solvent may be used. According to an especially preferred embodiment of the present invention the composition is in the form of a tablet, most especially a tablet made from compressed particulate material.

If the compositions are in the form of a viscous liquid or gel they preferably have a viscosity of at least 50 mPas when measured with a Brookfield RV Viscometer at 25° C. with Spindle 1 at 30 rpm.

The compositions of the invention will typically be used by placing them in a detergent dispenser e.g. in a dishwasher machine draw or free standing dispensing device in an automatic dishwashing machine. However, if the composition is in the form of a foam, liquid or gel then it may be applied to by any additional suitable means into the dishwashing machine, for example by a trigger spray, squeeze bottle or an aerosol.

Processes of Making Cleaning Compositions

The compositions of the invention may be made by any suitable method depending upon their format. Suitable manufacturing methods for detergent compositions are well known in the art, non-limiting examples of which are described in U.S. Pat. Nos. 5,879,584; 5,691,297; 5,574,005; 5,569,645; 5,565,422; 5,516,448; 5,489,392; and 5,486,303. Various techniques for forming detergent compositions in solid forms are also well known in the art, for example, detergent tablets may be made by compacting granular/particular material and may be used herein.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

The following examples are given by way of illustration only and therefore should not be construed to limit the scope of the invention.

EXAMPLE 1A

The initial formula used in this experiment was: 18.2% Amine Oxide (30% Active), 20.0% Lauryl Ether Sulfate (60% Active), 49.1% Lauryl Sulfate (30% Active), 9.1% propylene glycol and 3.6% water. The propylene glycol was added due to gelling of the surfactant and water mixture.

50 g of the above solution was used, and soybean oil was added sequentially up to 60.07 g. At this point, the solution was thick, white paste and it appeared that the oil was no longer being emulsified.

Next, a solution, of 10% Amine Oxide, 11% Lauryl Ether Sulfate, 27% Lauryl Sulfate and 52% water was prepared. This solution did not gel.

50 g of this surfactant solution was tested and titrated with oil to determine how much the system can hold. Soybean oil was added up to over 50% of the formula (54.96 g), over three times the active surfactant level. The solution got thicker and turned butter yellow.

Though this formulation can emulsify a significant amount of the difficult non trans fat oil, it cannot form a microemulsion. Moreover, this emulsion in not viscous, and will not allow the soil to be removed as efficiently as with a microemulsion.

EXAMPLE 1B

A formula containing 1.250% Amine Oxide and 1.375% Lauryl Ether Sulfate, with the same level of soybean oil as active surfactants, the $Mg^{2+}$ level was varied in order to determine the optimal level. The levels of $Mg^{2+}$ were: 0 g $MgCl_2$, 0.28 g $MgCl_2$, 1.40 g $MgCl_2$, 2.80 g $MgCl_2$. The balance of each formula is water. Each solution was split into 2 containers, one was held at room temperature and the other was held at 40 C. Visual observations of the solutions were made to determine if microemulsion formation occurs.

| | 0 $MgCl_2$ | 0.28 $MgCl_2$ | 1.4 $MgCl_2$ | 2.8 $MgCl_2$ |
|---|---|---|---|---|
| AO | 1.25 | 1.25 | 1.25 | 1.25 |
| SLES | 1.375 | 1.375 | 1.375 | 1.375 |
| $MgCl_2$ (30%) | 0.0 | 0.28 | 1.4 | 2.8 |
| DI | 97.375 | 97.095 | 95.975 | 94.575 |
| Soybean Oil | 1.2 | 1.2 | 1.2 | 1.2 |

| Room Temp | 1 hour | 1 day |
|---|---|---|
| 0 g $MgCl_2$ | Clear water layer, emulsion layer on top | Clear water layer, emulsion layer on top |

-continued

| Room Temp | 1 hour | 1 day |
|---|---|---|
| 0.28 g $MgCl_2$ | Clear water layer, emulsion layer on top | Clear water layer, emulsion layer on top |
| 1.40 g $MgCl_2$ | Cloudy white water layer, emulsion layer on top | Hazy white water layer, emulsion layer on top |
| 2.80 g $MgCl_2$ | Cloudy white water layer, emulsion layer on top | Hazy white water layer, emulsion layer on top |

| 40 C. | 1 hour | 1 day |
|---|---|---|
| 0 g $MgCl_2$ | Clear water layer, emulsion layer on top | Clear water layer, emulsion layer on top |
| 0.28 g $MgCl_2$ | Clear water layer, emulsion layer on top | Clear water layer, emulsion layer on top |
| 1.40 g $MgCl_2$ | Cloudy white water layer, emulsion layer on top | Hazy white water layer, emulsion layer on top |
| 2.80 g $MgCl_2$ | Darker cloudy white water layer, emulsion layer on top | Hazy white water layer, emulsion layer on top |

The data indicates that the increased $Mg^{2+}$ helps the LES emulsify the oil. However, no substantial microemulsion phase was formed.

EXAMPLE 1C

Dioctyl sulfosuccinate (DOSS) is another effective linker surfactant. DOSS has a twin hydrophobic tail (resulting in a large effective cross-sectional area), and is more prone to planar packing at the water and oil interface. Visual observations of the solutions were made to determine if microemulsion formation occurs.

The surfactant ratios were tested per the table below.

| | 0 $MgCl_2$ | 0.14 $MgCl_2$ | 0.28 $MgCl_2$ | 1.4 $MgCl_2$ |
|---|---|---|---|---|
| AO | 0.26 | 0.26 | 0.26 | 0.26 |
| SLES | 1.31 | 1.31 | 1.31 | 1.31 |
| dioctyl sulfosuccinate | 0.48 | 0.48 | 0.48 | 0.48 |
| $MgCl_2$ (30%) | 0 | 0.14 | 0.28 | 1.4 |
| DI | 97.95 | 97.81 | 97.67 | 96.55 |
| Oil | 1.2 | 1.2 | 1.2 | 1.2 |

| Room Temp | 1 hour | 1 day |
|---|---|---|
| 0 g $MgCl_2$ | Cloudy white water layer with emulsion layer | Clear water layer with emulsion layer. |
| 0.14 g $MgCl_2$ | Cloudy white water layer with emulsion layer | Clear water layer with emulsion layer |
| 0.28 g $MgCl_2$ | Cloudy white water layer with emulsion layer | Clear water layer-small oil bubbles visible in emulsion layer indicating the start of an oil layer |
| 1.40 g $MgCl_2$ | Cloudy water layer-small oil bubbles visible in emulsion layer indicating the start of an oil layer | Clear water layer-small oil bubbles visible in emulsion layer indicating the start of an oil layer |

| 40 C. | 1 hour | 1 day |
|---|---|---|
| 0 g $MgCl_2$ | Cloudy white water layer with emulsion layer | Clear water layer with emulsion layer |
| 0.14 g $MgCl_2$ | Cloudy white water layer with emulsion layer | Clear water layer with emulsion layer |

-continued

| 40 C. | 1 hour | 1 day |
|---|---|---|
| 0.28 g $MgCl_2$ | Cloudy white water layer with emulsion layer-has a few oil bubbles | Clear water layer-small oil bubbles visible in emulsion layer |
| 1.40 g $MgCl_2$ | Cloudy white water layer with emulsion layer-emulsion layer has oil bubbles | Clear water layer-large oil bubbles on top of emulsion layer |

Overall, the Sodium Dioctyl Sulfosuccinate solutions appear to form fairly good emulsions showing that it is effective at aiding in the planar packing of surfactant at the oil interface.

EXAMPLE 1D

Experiments using the extended surfactant in place of the LES were performed. Visual observations of the solutions were made to determine if microemulsion formation occurs.

| | Percent | Percent | Percent | Percent | Percent |
|---|---|---|---|---|---|
| DI | 80.65 | 79.53 | 75.03 | 69.40 | 58.15 |
| Amine Oxide | 5.00 | 5.00 | 5.00 | 5.00 | 5.00 |
| X-AES | 14.35 | 14.35 | 14.35 | 14.35 | 14.35 |
| $MgCl_2$ (30%) | 0.00 | 1.13 | 5.63 | 11.25 | 22.50 |
| Soybean Oil | 4.80 | 4.80 | 4.80 | 4.80 | 4.80 |

| $MgCl_2$ level | Observations Day 1 | Observations Day 2 |
|---|---|---|
| 0 g | Cloudy water layer with oil addition. | Clear water layer with small emulsion layer |
| 1.125 g | Cloudy water layer with oil addition. | Clear water layer with blue hue and small emulsion layer |
| 5.625 g | Cloudy water layer with oil addition. | Cloudy water layer with blue hue and small emulsion layer |
| 11.25 g | Cloudy water layer with oil addition. | 3 layers: small emulsion layer, cloudy blue intermediate layer and a clear blue water layer |
| 22.50 g | Cloudy water layer with oil addition. | 3 layers: small emulsion layer, cloudy blue intermediate layer and a clear blue water layer |

| $MgCl_2$ level | Observations Day 6 (room temp) |
|---|---|
| 0 g | Clear water layer with small emulsion layer |
| 1.125 g | Clear water layer with small emulsion layer |
| 5.625 g | Slightly blue water layer with emulsion layer |
| 11.25 g | Uniform blue water layer with emulsion layer |
| 22.50 g | Uniform blue water layer with emulsion layer |

EXAMPLE 1E

Experiments using the extended surfactant in place of the LES were performed. Visual observations of the solutions were made to determine if microemulsion formation occurs.

| | 0 $MgCl_2$ | 0.28 $MgCl_2$ | 1.4 $MgCl_2$ | 2.8 $MgCl_2$ | 5.6 $MgCl_2$ |
|---|---|---|---|---|---|
| AO | 1.25 | 1.25 | 1.25 | 1.25 | 1.25 |
| X-AES | 3.59 | 3.59 | 3.59 | 3.59 | 3.59 |
| $MgCl_2$ | 0 | 0.28 | 1.4 | 2.8 | 5.6 |
| DI | 95.16 | 94.88 | 93.76 | 92.36 | 89.56 |
| Oil | 1.2 | 1.2 | 1.2 | 1.2 | 1.2 |

| Room Temp | 1 hour | 1 day |
|---|---|---|
| 0 g $MgCl_2$ | Clear water layer with small emulsion layer | Clear water layer with small emulsion layer |
| 0.28 g $MgCl_2$ | Clear water layer with small emulsion layer | Clear water layer with small emulsion layer |
| 1.40 g $MgCl_2$ | Clear water layer with smaller emulsion layer | Clear water layer with small emulsion layer |
| 2.80 g $MgCl_2$ | Clear water layer with smaller emulsion layer | Clear water layer with small emulsion layer |
| 5.60 g $MgCl_2$ | Clear water layer with smaller emulsion layer | Clear water layer with small emulsion layer |

| 40 C. | 1 hour | 1 day |
|---|---|---|
| 0 g $MgCl_2$ | Clear water layer with small emulsion layer | Clear solution, oil layer on top |
| 0.28 g $MgCl_2$ | Clear water layer with small emulsion layer | Clear solution, oil layer on top |
| 1.40 g $MgCl_2$ | Definite blue hue in water layer, some emulsion layer | Blue hue in water layer, some emulsion layer on top |
| 2.80 g $MgCl_2$ | Blue hue, somewhat cloudy water layer with emulsion layer | 3 layers: small emulsion layer, cloudy blue intermediate layer and a clear blue water layer |
| 5.60 g $MgCl_2$ | Blue hue, cloudy water layer with emulsion layer | Clear water layer and a small layer of blue emulsion on top |

As can be seen from the description, some of the test solutions are intensely blue, and are stable with storage. These are indicative of formation of microemulsions. Theoretically, it is believed that most of the oils are stabilized in a bi-continuous microemulsion phase. Many microemulsions are blue in appearance.

EXAMPLE 2

Synergistic Combinations for Soil Removal with Extended Anionic Surfactants

There have been many laundry fires during the transportation of the soiled towels to laundering facilities for cleaning, which are caused by the exothermic polymerization of the conjugated double bonds of the non-transfats. Alleviating this issue by using a prespotting method, where the oily towels would be sprayed or treated with the product before being taken for cleaning has several advantages. First, water content is added from the product to the towel, lowering the risk of fire. Second, by prespotting, the formation of microemulsions with the non-transfats (both time and ease of formation), is enhanced which will facilitate its eventual removal. Third, the formation of microemulsions also separates or spread out the non-transfat "particles", reducing its polymerization. Fourth, the surfactants already prespotted onto the towels can be utilized in the first step in the washwheel and limit the amount of detergent needed.

Another use in a laundry application would be as a standard laundry detergent. In this case, the microemulsion would be formed in the washwheel.

EXAMPLE 2A

This test will compare the efficacy of the above Formula with 5.6% $MgCl_2$ (30%) to formulations containing NPE and AE surfactants (Commercial Detergent A and Commercial Detergent B) using a pre-spotting method.

The Formulas used are as follows:

| Experimental Formula | Percent |
|---|---|
| DI Water | 55.69 |
| X-AES, 23% | 28.71 |
| Cl2 AO, 30% | 10.00 |
| MgCl2, 30% | 5.60 |

Commercial Detergent A is an NPE based detergent with 73.8% active surfactants and Commercial Detergent B is an AE based detergent with 52.8% active surfactants.

The Builder formula is a builder system with 31.5% active sodium hydroxide. The procedures used included the following:

Three terry swatches soiled with soybean oil were used for all testing. Each swatch was soiled with 0.30 g of soybean oil. The swatches were then prespotted with detergent so 0.30 g of active surfactant is present on the swatch. The test was performed immediately after soiling and treating the swatches.

At the rinse water, the concentration of $Mg^{2+}$ (if only from the prespot) will be diluted greatly and rapidly. Even after the dilution, the concentration of $Mg^{2+}$ may not be enough to form a microemulsion. Potentially, the optimal removal can be obtained with by dosing with the optimal concentration of $Mg^{2+}$. However, the cost may be increased significantly.

Two levels of alkalinity were used for this testing. First, the ionic strength of the alkalinity solution was matched to the $Mg^{2+}$ system by using conductivity. Second, the recommended high use concentration for the Builder was used.

Five different rinsing procedures were used, and are as follows:

1. Water Rinse: Rinse all three swatches in 1 L of 5 gpg cold water for 5 minutes in a 2 L beaker with a 2½" stir bar at 250 rpm. Then transfer the swatches to another 2 L beaker with 1 L of 5 gpg cold water and agitate with a 2½" stir bar at 250 rpm.
2. $MgCl_2$ Rinse: Rinse all three swatches in 1 L of 5 gpg cold water solution with 5.6% $MgCl_2$ (30%) in a 2 L beaker with a 2½" stir bar at 250 rpm. Then transfer the swatches to another 2 L beaker with 1 L of 5 gpg cold water solution with 5.6% $MgCl_2$ (30%) and agitate with a 2½" stir bar at 250 rpm.
3. Builder Rinse@4372 ppm alkalinity (equal ionic strength): Rinse all three swatches in 1 L of 5 gpg cold water solution with alkali matching the ionic strength of 5.6% $MgCl_2$ (30%) in a 2 L beaker with a 2½" stir bar at 250 rpm. Then transfer the swatches to another 2 L beaker with 1 L of 5 gpg cold water solution with alkali and agitate with a 2½" stir bar at 250 rpm.
4. Builder Rinse@2800 ppm alkalinity (high use concentration): Rinse all three swatches in 1 L of 5 gpg cold water solution with alkali matching recommended use level of the Builder in a 2 L beaker with a 2½" stir bar at 250 rpm. Then transfer the swatches to another 2 L beaker with 1 L of 5 gpg cold water solution with alkali and agitate with a 2½" stir bar at 250 rpm.
5. $MgCl_2$ Rinse water $2^{nd}$ rinse: Rinse all three swatches in 1 L of 5 gpg cold water solution with 5.6% $MgCl_2$ (30%) in a 2 L beaker with a 2½" stir bar at 250 rpm. Then transfer the swatches to another 2 L beaker with 1 L of 5 gpg cold water solution and agitate with a 2½" stir bar at 250 rpm.

| Experimental Formula | INITIAL | Oil | FINAL | Soil Removed | % Soil Removed |
|---|---|---|---|---|---|
| $MgCl_2$ | 1.9098 | 0.3 | 1.9438 | 0.266 | 88.67 |
| | 1.9042 | 0.32 | 1.9328 | 0.2914 | 91.06 |
| | 1.9788 | 0.3 | 2.0093 | 0.2695 | 89.83 |
| | Average | | | | 89.85 |
| 4372 ppm | 2.0205 | 0.3 | 2.1444 | 0.1761 | 58.70 |
| Builder | 2.0789 | 0.3 | 2.1965 | 0.1824 | 60.80 |
| | 2.062 | 0.31 | 2.1833 | 0.1887 | 60.87 |
| | Average | | | | 60.12 |
| Water | 1.9946 | 0.3 | 2.0338 | 0.2608 | 86.93 |
| | 1.9324 | 0.3 | 1.9564 | 0.276 | 92.00 |
| | 2.0271 | 0.3 | 2.0895 | 0.2376 | 79.20 |
| | Average | | | | 86.04 |
| 2800 ppm | 1.9754 | 0.3 | 2.0796 | 0.1958 | 65.27 |
| Builder | 1.9369 | 0.31 | 2.0278 | 0.2191 | 70.68 |
| | 2.0138 | 0.31 | 2.1219 | 0.2019 | 65.13 |
| | Average | | | | 67.02 |
| $MgCl_2$ Water | 1.9380 | 0.33 | 1.9664 | 0.3016 | 91.39 |
| $2^{nd}$ rinse | 2.0101 | 0.30 | 2.0278 | 0.2823 | 94.10 |
| | 1.9804 | 0.31 | 2.0073 | 0.2831 | 91.32 |
| | Average | | | | 92.27 |

| Commercial Detergent A | INITIAL | Oil | FINAL | Soil Removed | % Soil Removed |
|---|---|---|---|---|---|
| $MgCl_2$ | 1.9882 | 0.31 | 2.1407 | 0.1575 | 50.81 |
| | 2.0052 | 0.3 | 2.1444 | 0.1608 | 53.60 |
| | 1.9957 | 0.3 | 2.1426 | 0.1531 | 51.03 |
| | Average | | | | 51.81 |
| 4372 ppm | 1.989 | 0.31 | 2.1337 | 0.1653 | 53.32 |
| Builder | 1.9253 | 0.3 | 2.067 | 0.1583 | 52.77 |
| | 2.0986 | 0.3 | 2.2344 | 0.1642 | 54.73 |
| | Average | | | | 53.61 |
| Water | 2.0859 | 0.31 | 2.2243 | 0.1716 | 55.35 |
| | 1.9795 | 0.31 | 2.1114 | 0.1781 | 57.45 |
| | 1.9053 | 0.3 | 2.0563 | 0.149 | 49.67 |
| | Average | | | | 54.16 |
| 2800 ppm | 2.0546 | 0.3 | 2.2138 | 0.1408 | 46.93 |
| Builder | 2.0463 | 0.31 | 2.2104 | 0.1459 | 47.06 |
| | 1.9405 | 0.3 | 2.0993 | 0.1412 | 47.07 |
| | Average | | | | 47.02 |

| Commercial Detergent B | INITIAL | Oil | FINAL | Soil Removed | % Soil Removed |
|---|---|---|---|---|---|
| $MgCl_2$ | 2.1154 | 0.31 | 2.2426 | 0.1828 | 58.97 |
| | 2.1039 | 0.3 | 2.2257 | 0.1782 | 59.40 |
| | 2.0177 | 0.3 | 2.1476 | 0.1701 | 56.70 |
| | Average | | | | 58.36 |
| 4372 ppm | 2.2114 | 0.3 | 2.3324 | 0.179 | 59.67 |
| Builder | 2.0354 | 0.31 | 2.1526 | 0.1928 | 62.19 |
| | 2.0274 | 0.31 | 2.1485 | 0.1889 | 60.94 |
| | Average | | | | 60.93 |

-continued

| Commercial Detergent B | INITIAL | Oil | FINAL | Soil Removed | % Soil Removed |
|---|---|---|---|---|---|
| Water | 1.9739 | 0.31 | 2.0821 | 0.2018 | 65.10 |
| | 2.1233 | 0.31 | 2.2334 | 0.1999 | 64.48 |
| | 2.2145 | 0.3 | 2.3288 | 0.1857 | 61.90 |
| | Average | | | | 63.83 |
| 2800 ppm | 1.9827 | 0.31 | 2.12 | 0.1727 | 55.71 |
| Builder | 2.0526 | 0.3 | 2.1879 | 0.1647 | 54.90 |
| | 1.9896 | 0.31 | 2.1124 | 0.1872 | 60.39 |
| | Average | | | | 57.00 |

FIG. 1 shows the results of the percent soil removal with the various surfactants discussed above. The swatches were soiled with 0.3 g Soybean Oil and treated with an equal active amount of surfactant. Swatches were allowed to sit for 24 hours before testing. Three swatches per test were used and subjected to a 5 min "wash" and 2 min "rinse" step. Each step consisted of 1 L of solution made with 5 gpg water at 72 F and agitated with a 2½" stir bar at 250 rpm. Four different solutions were used for the wash step: (1) water; (2) 5.6% MgCl2 (30%); (3) Builder at equal conductivity (1.51%); and (4) Builder at high recommended use level (0.97%). Unless otherwise specified, the rinse step used one liter of the same solution as the wash step.

EXAMPLE 2B

Another prespot test was performed where the swatches were soiled with the oil and treated with the surfactant then allowed to sit for 24 hours. The test was performed using the 5.6% $MgCl_2$ (30%) rinse procedure as described in the previous example.

Prespot/beaker test-Mg Rinse

| Used Oil | INITIAL | Oil | FINAL | Soil Removed (g) | % Soil Removed |
|---|---|---|---|---|---|
| Commercial | 2.0323 | 0.31 | 2.2238 | 0.1185 | 38.23 |
| Detergent B | 2.0474 | 0.30 | 2.2368 | 0.1106 | 36.87 |
| | 1.9031 | 0.32 | 2.0935 | 0.1296 | 40.50 |
| | | | | | 38.53 |
| Commercial | 2.1316 | 0.32 | 2.2749 | 0.1767 | 55.22 |
| Detergent A | 2.3045 | 0.32 | 2.4452 | 0.1793 | 56.03 |
| | 1.9309 | 0.32 | 2.0638 | 0.1871 | 58.47 |
| | | | | | 56.57 |
| Experimental | 2.1452 | 0.31 | 2.1901 | 0.2651 | 85.52 |
| Formula | 2.0387 | 0.31 | 2.1025 | 0.2462 | 79.42 |
| | 1.9850 | 0.30 | 2.0510 | 0.2340 | 78.00 |
| | | | | | 80.98 |

Figure 2:
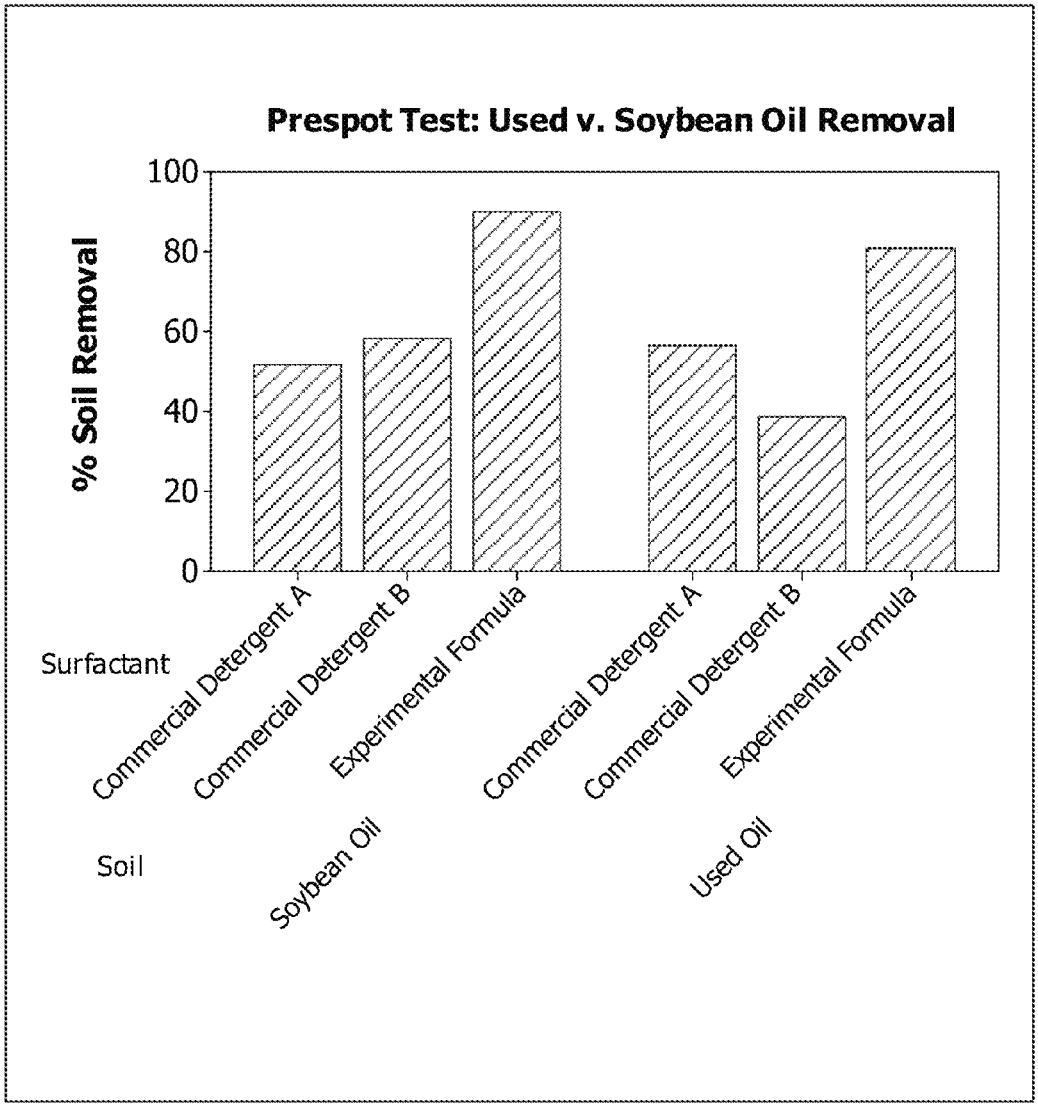
FIG. 2 is a graph of the percent soil removal prespot test of used verses soybean oil removal for the surfactant system of the invention, Commercial Detergent A and Commercial Detergent B. As can be seen the surfactant system of the invention significantly outperformed Commercial Detergent A and Commercial Detergent B at room temperature.

FIG. 2 shows the results of the pre-spot test. With a prespot method, the X-AES/AO/$Mg^{2+}$ system significantly out-performs the well established Commercial Detergent A and Commercial Detergent B at room temperature. The best performance of X-AES/AO/$Mg^{2+}$ is achieved with first "wash" liquid after prespotting boosted with the optimal level of $Mg^{2+}$. However, even with no $Mg^{2+}$ dosing in first "wash", removal results are still excellent. This is important for a lower cost offering. Theoretically, we speculate that the key moment to form the microemulsion is through the duration of prespotting. Once it is formed, it is effectively rinsed off and removed, even with just water alone. It is important to note that the soil removal level of X-AES/AO/$Mg^{2+}$ approaches 90% while those with Commercial Detergent A and Commercial Detergent B are in the 50% and 60% range. 90% soil removal puts it in the range of performance of regular detergents at regular wash temperature of ~150 F. In other words, we have an offering that is especially suited for low temperature laundry. X-AES/AO/$Mg^{2+}$ system is highly effective against both fresh and used soybean oil (non-transfat).

EXAMPLE 2C

A tergotometer test was performed as we wanted to test the experimental formula against the Commercial Detergent A and Commercial Detergent B formulas in a washwheel-like environment at room temp.

Test Conditions: 1 L of 5 gpg water at 76° F., three swatches put in each tergotometer pot, swatches soiled with soybean oil and used non-trans fat oil obtained from a restaurant fryer, agitation at 100 rpm, a 5 minute "wash" step followed by a 2 minute "rinse" in a new 1 L tergotometer pot with 5 gpg water, and surfactant added to the washwater to match the soil levels (Experimental Formula solution at 9.36 g, Commercial Detergent A at 1.22 g, and Commercial Detergent B at 1.70 g).

| Experimental Formula | Percent |
|---|---|
| DI Water | 55.69 |
| X-AES, 23% | 28.71 |
| C12 AO, 30% | 10.00 |
| MgCl2, 30% | 5.60 |

Tergotometer Test @ 76 F.

| Soybean Oil | INITIAL | Oil | FINAL | Soil Removed (g) | % Soil Removed |
|---|---|---|---|---|---|
| Experimental | 1.9552 | 0.31 | 2.0351 | 0.2301 | 74.23 |
| Formula | 1.8602 | 0.30 | 1.9170 | 0.2432 | 81.07 |
| | 2.0519 | 0.31 | 2.1396 | 0.2223 | 71.71 |
| | | | | | 75.67 |
| Commercial | 1.9019 | 0.31 | 1.9706 | 0.2413 | 77.84 |
| Detergent A | 1.9685 | 0.30 | 2.0231 | 0.2454 | 81.80 |
| | 2.0004 | 0.31 | 2.1463 | 0.1641 | 52.94 |
| | | | | | 70.86 |
| Commercial | 2.0152 | 0.31 | 2.1512 | 0.1740 | 56.13 |
| Detergent B | 1.9488 | 0.30 | 2.0367 | 0.2121 | 70.70 |
| | 1.9521 | 0.31 | 2.0463 | 0.2158 | 69.63 |
| | | | | | 65.48 |

| Used Oil | INITIAL | Oil | FINAL | Soil Removed (g) | % Soil Removed |
|---|---|---|---|---|---|
| Experimental | 1.9115 | 0.31 | 2.1052 | 0.1163 | 37.52 |
| Formula | 1.9413 | 0.30 | 2.0990 | 0.1423 | 47.43 |
| | 1.9741 | 0.32 | 2.1464 | 0.1477 | 46.16 |
| | | | | | 43.70 |
| Commercial | 2.1748 | 0.30 | 2.2791 | 0.1957 | 65.23 |
| Detergent A | 2.0230 | 0.32 | 2.0861 | 0.2569 | 80.28 |
| | 1.8783 | 0.32 | 1.9457 | 0.2526 | 78.94 |
| | | | | | 74.82 |
| Commercial | 1.9450 | 0.31 | 2.0175 | 0.2375 | 76.61 |
| Detergent B | 1.8150 | 0.30 | 1.8935 | 0.2215 | 73.83 |
| | 1.9876 | 0.30 | 2.0633 | 0.2243 | 74.77 |
| | | | | | 75.07 |

Figure 3:
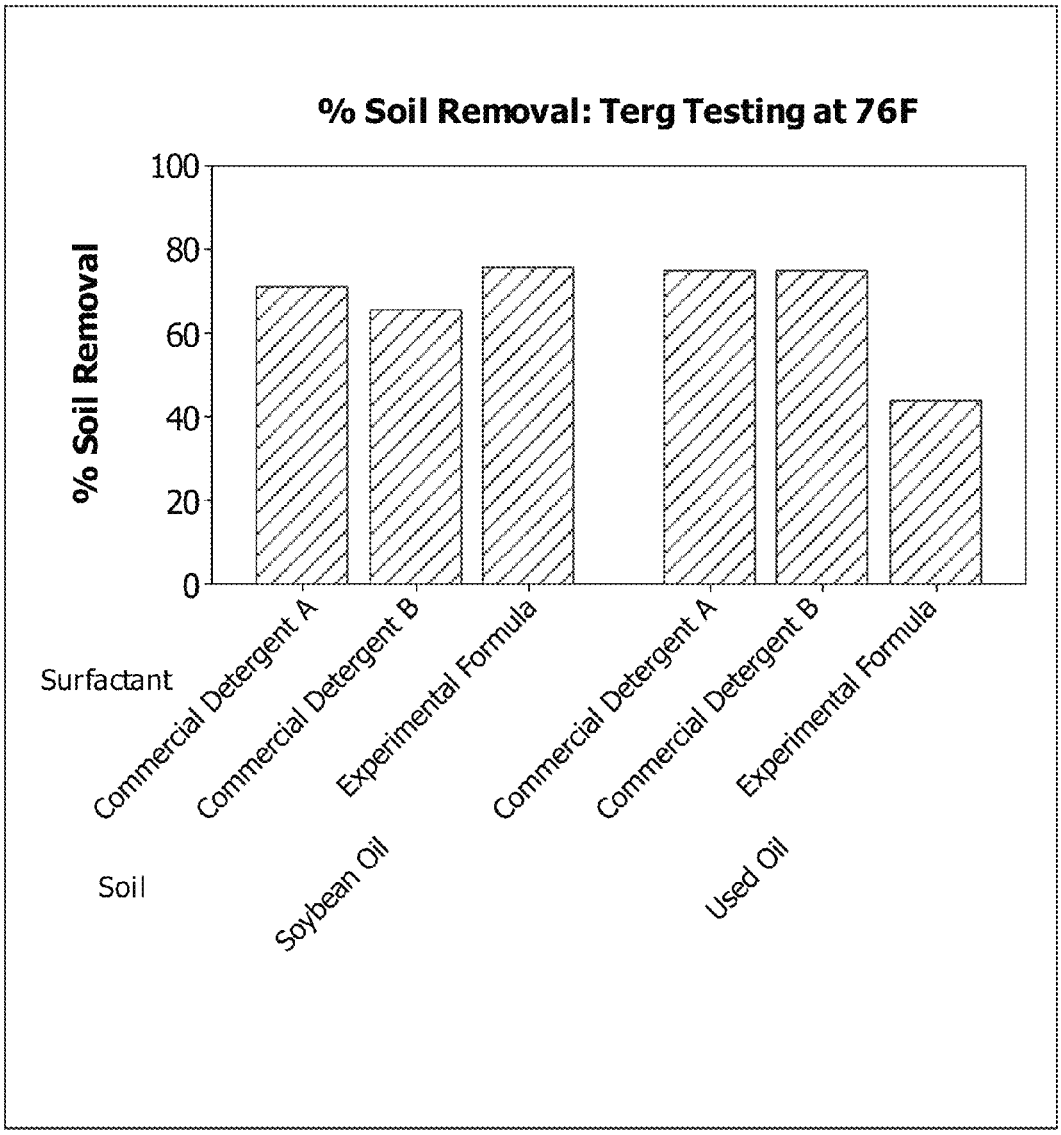
FIG. 3 is a graph of the percent soil removal for the terg test at 76° F. for soybean and used oil for the surfactant system of the invention, Commercial Detergent A and Commercial Detergent B. One can see that the surfactant system of the invention works similar to the traditional detergents on soybean oil.

FIG. 3 is a graph showing the results above. In this test, it does not appear as though the experimental formula performs as well, specifically with the used oil. However, no $MgCl_2$ was added to the washwater or the rinse water. This does not allow the desired planar interface to form as the ionic strength of the solution is not optimal.

EXAMPLE 2D

This test repeats the previous test, but with 5.6% $MgCl_2$ (30%) added to the washwater for the experimental formula. The concentration of $Mg^{2+}$ (if only from the formula) will be diluted greatly and rapidly. Even after the dilution, the concentration of $Mg^{2+}$ may not be enough to form a microemulsion. Potentially, the optimal removal can be obtained with by dosing with the optimal concentration of $Mg^{2+}$. However, the cost may be increased significantly. Also, the test was run at both room temp and 140° F.

Test Conditions: 1 L of 5 gpg water at 76° F. and 140° F. (with 5.6% $MgCl_2$ (30%) added for the experimental formula test), three swatches put in each tergotometer pot, swatches soiled with soybean oil and used non-trans fat oil obtained from a restaurant fryer, agitation at 100 rpm, a 5 minute "wash" step followed by a 2 minute "rinse" in a new 1 L tergotometer pot with 5 gpg water, and surfactant added to the washwater to match the soil levels (Experimental Formula at 9.36 g, Commercial Detergent A at 1.22 g, and Commercial Detergent B at 1.70 g).

| Tergotometer Test Used Oil-140 F. | INITIAL | Oil | FINAL | Soil Removed (g) | % Soil Removed |
|---|---|---|---|---|---|
| Commercial Detergent B | 1.6519 | 0.30 | 1.6639 | 0.2880 | 96.00 |
| | 1.9170 | 0.30 | 1.9273 | 0.2897 | 96.57 |
| | 1.9434 | 0.34 | 1.9530 | 0.3304 | 97.18 |
| | | | | | 96.58 |
| Experimental Formula | 1.8804 | 0.30 | 2.0453 | 0.1351 | 45.03 |
| | 1.9858 | 0.31 | 2.1704 | 0.1254 | 40.45 |
| | 1.9635 | 0.31 | 2.1566 | 0.1169 | 37.71 |
| | | | | | 41.06 |
| Commercial Detergent A | 1.9316 | 0.30 | 1.9356 | 0.2960 | 98.67 |
| | 2.0835 | 0.30 | 2.0901 | 0.2934 | 97.80 |
| | 1.9333 | 0.30 | 1.9365 | 0.2968 | 98.93 |
| | | | | | 98.47 |

| Soybean Oil-140 F. | INITIAL | Oil | FINAL | Soil Removed (g) | % Soil Removed |
|---|---|---|---|---|---|
| Commercial Detergent B | 2.0426 | 0.31 | 2.0555 | 0.2971 | 95.84 |
| | 1.9884 | 0.30 | 1.9970 | 0.2914 | 97.13 |
| | 1.9596 | 0.37 | 1.9765 | 0.3531 | 95.43 |
| | | | | | 96.13 |
| Experimental Formula | 1.9155 | 0.30 | 2.0123 | 0.2032 | 67.73 |
| | 2.0143 | 0.30 | 2.0927 | 0.2216 | 73.87 |
| | 2.0138 | 0.30 | 2.0971 | 0.2167 | 72.23 |
| | | | | | 71.28 |
| Commercial Detergent A | 1.9004 | 0.33 | 1.9095 | 0.3209 | 97.24 |
| | 2.1578 | 0.30 | 2.1680 | 0.2898 | 96.60 |
| | 2.0059 | 0.30 | 2.0123 | 0.2936 | 97.87 |
| | | | | | 97.24 |

| Used Oil-76 F. | INITIAL | Oil | FINAL | Soil Removed (g) | % Soil Removed |
|---|---|---|---|---|---|
| Commercial Detergent B | 2.0029 | 0.30 | 2.0374 | 0.2655 | 88.50 |
| | 2.0633 | 0.30 | 2.0946 | 0.2687 | 89.57 |
| | 2.0285 | 0.32 | 2.0402 | 0.3083 | 96.34 |
| | | | | | 91.47 |
| Experimental Formula | 1.9242 | 0.33 | 2.0630 | 0.1912 | 57.94 |
| | 1.9637 | 0.32 | 2.0867 | 0.1970 | 61.56 |
| | 1.9125 | 0.30 | 2.0494 | 0.1631 | 54.37 |
| | | | | | 57.96 |
| Commercial Detergent A | 2.0449 | 0.33 | 2.0669 | 0.3080 | 93.33 |
| | 2.1375 | 0.34 | 2.1628 | 0.3147 | 92.56 |
| | 1.9739 | 0.32 | 1.9927 | 0.3012 | 94.13 |
| | | | | | 93.34 |

| Soybean Oil-76 F. | INITIAL | Oil | FINAL | Soil Removed (g) | % Soil Removed |
|---|---|---|---|---|---|
| Commercial Detergent B | 2.0841 | 0.30 | 2.1298 | 0.2543 | 84.77 |
| | 1.9791 | 0.33 | 2.0523 | 0.2568 | 77.82 |
| | 2.0900 | 0.32 | 2.1429 | 0.2671 | 83.47 |
| | | | | | 82.02 |
| Experimental | 2.0788 | 0.31 | 2.1155 | 0.2733 | 88.16 |

-continued

| Soybean Oil-76 F. | INITIAL | Oil | FINAL | Soil Removed (g) | % Soil Removed |
|---|---|---|---|---|---|
| Formula | 2.0052 | 0.33 | 2.0527 | 0.2825 | 85.61 |
| | 2.0355 | 0.30 | 2.0780 | 0.2575 | 85.83 |
| | | | | | 86.53 |
| Commercial | 2.0796 | 0.33 | 2.0950 | 0.3146 | 95.33 |
| Detergent A | 2.1134 | 0.32 | 2.1393 | 0.2941 | 91.91 |
| | 2.0271 | 0.31 | 2.0445 | 0.2926 | 94.39 |
| | | | | | 93.8756 |

Figure 4:
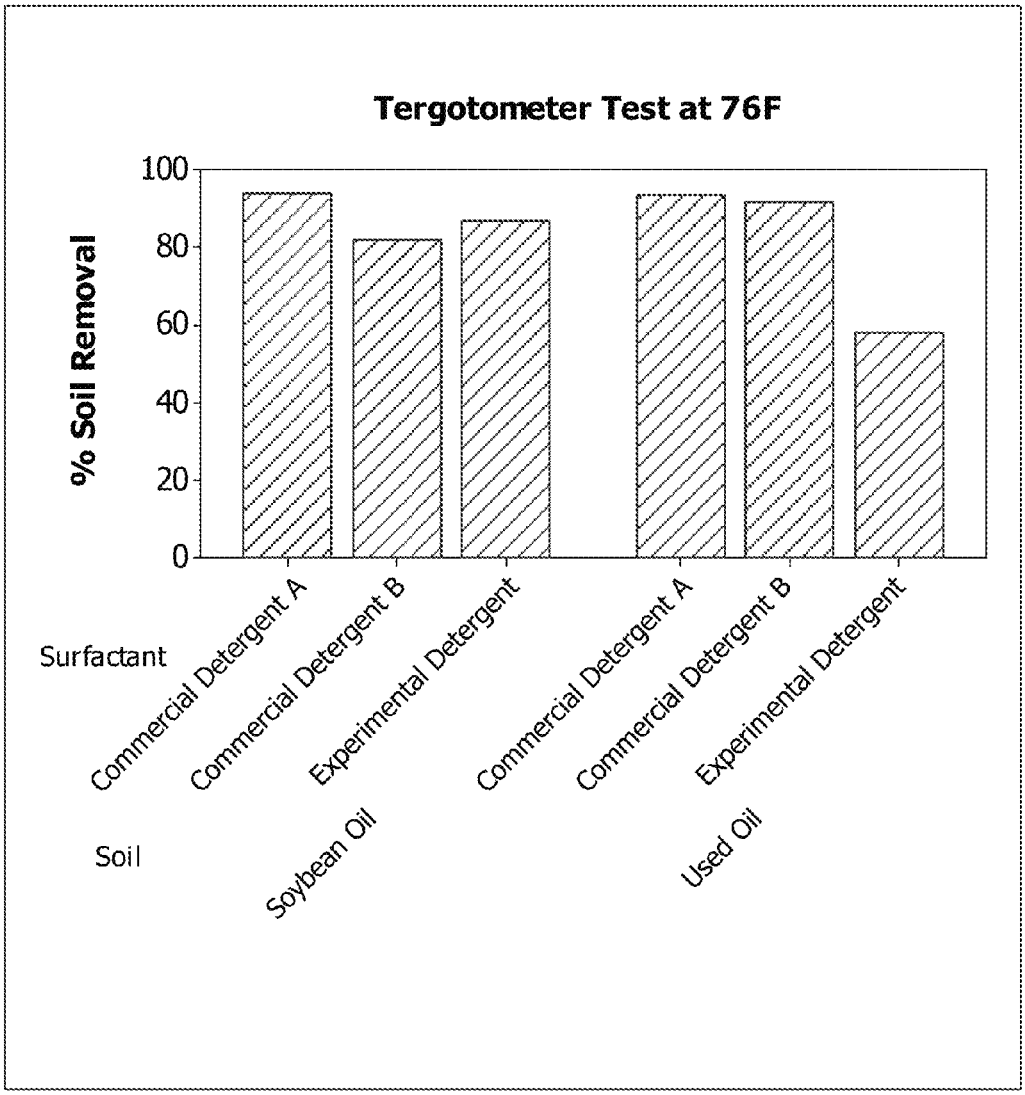
FIGS. 4 and 5 represent graphs of the percent soil removal at different temperatures for the surfactant system of the invention, Commercial Detergent A and Commercial Detergent B. The results show that the surfactant system of the invention performs better at lower temperatures.
Figure 5:
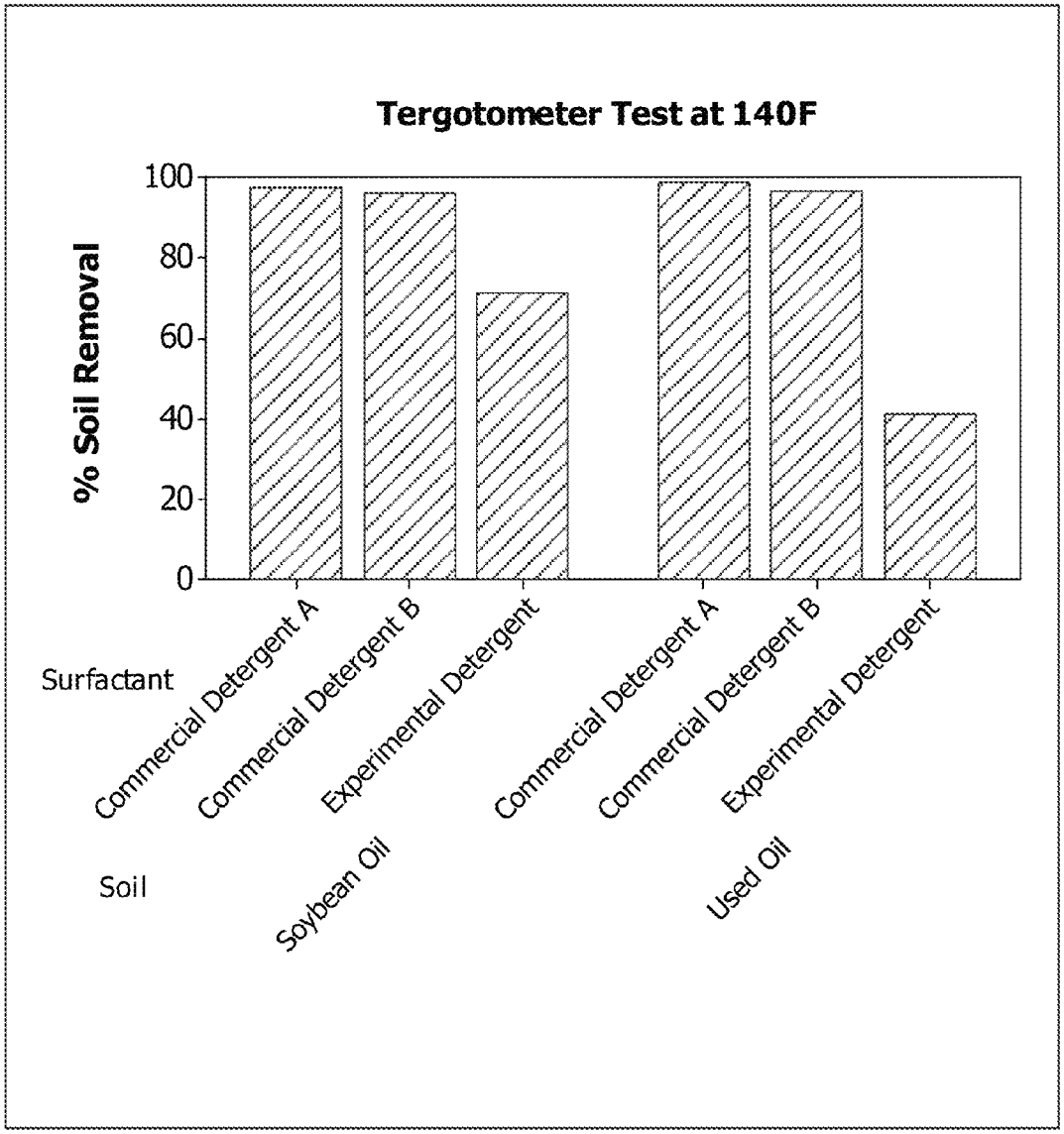

FIGS. 4 and 5 show the results with the $Mg^{2+}$ added. The results show that while the pre-spotting method performed better, the new formula performed at least as well as traditional formulas on soybean oil and performs better at lower temperatures than higher temperatures. Moreover, this formulation is less prone to fires and residual smoking issues and represents a safer cleaning alternative.

What is claimed is:

1. A surfactant system or cleaning composition comprising:

an extended chain anionic surfactant of formula:

$$R\text{-}[L]_x\text{-}[O\text{—}CH_2\text{—}CH_2]_y\text{-}M$$

where R is a linear or branched, saturated or unsaturated, substituted or unsubstituted, aliphatic or aromatic hydrocarbon radical having from about 6-20 carbon atoms, L is a linking group, M is an ionic species, x is the chain length of the linking group ranging from 2-16, and y is the average degree of ethoxylation ranging from 1-5;

a linker surfactant comprising dioctyl sulfosuccinate; and a multiply charged cation component selected from the group consisting of: Ca2+, Mg2+, a chelating agent, a source of alkalinity, or combination thereof;

wherein the cleaning composition is capable of removing oily soils; wherein the ratio of extended chain anionic surfactant to linker surfactant is from 1:0.167 to 1:2.33 and the ratio of extended chain anionic surfactant to multiply charged cation is from 1:0.01 to 1:5.31.

2. The surfactant system of claim 1 wherein said surfactant system is employed under alkaline or acid conditions.

3. The surfactant system of claim 1 wherein said surfactant system removes oily soils at room temperature.

4. The surfactant system of claim 1 wherein said linker surfactant consists of dioctyl sulfosuccinate.

5. The surfactant system of claim 1 wherein said multiply charged cation is Ma2+.

6. The surfactant system of claim 1 wherein said system forms an emulsion or microemulsion with oily soils.

7. The surfactant system of claim 6 wherein said emulsion or microemulsion. is formed with non-trans fats.

8. The surfactant system of claim 1 wherein M is any ionic species selected from the group consisting of carboxylates, sulfonates, sulfates, phosphates, and combinations thereof.

9. The surfactant system of claim 1 wherein said system is used as a pre-spotter.

10. A cleaning composition including the surfactant system of claim 1.

11. The cleaning composition of claim 10 wherein said cleaning composition is a hard surface cleaner.

12. The cleaning composition of claim 10 wherein said cleaning composition is a detergent.

13. A method for removing a soil from a hard or soft surface comprising:

applying a cleaning composition containing the surfactant system according to claim 1 to the hard or soft surface and;

rinsing and/or wiping the cleaning composition from the hard or soft surface.

14. An emulsion product comprising:

the surfactant system of claim 1 and an oil.

15. The emulsion of claim 14 wherein said oil is a vegetable oil.

16. The emulsion of claim 14 wherein said emulsion is an oil based lubricant.

17. The emulsion of claim 14 wherein said oil is a synthetic oil.

18. The emulsion of claim 14 wherein said emulsion is a microemulsion.

19. A surfactant system comprising:

from about 15% by weight to about 45% by weight of an anionic extended chain surfactant;

from about 2.5% by weight to about 17.5% by weight linker, wherein said linker comprises dioctyl sulfosuccinate;

and from about 2.5% to about 10% by weight of multiply charged cation;

wherein said extended chain anionic surfactant comprises a compound of the formula:

$$R\text{-}[L]_x\text{-}[O\text{—}CH_2\text{—}CH_2]_y\text{-}M$$

where R is a linear or branched, saturated or unsaturated, substituted or unsubstituted, aliphatic or aromatic hydrocarbon radical having from about 6 to 20 carbon atoms, L is a linking group, M is any ionic species, x is the chain length of the linking group ranging from 2-16, and y is the average degree of ethoxylation ranging from 1 to 5;

wherein the ratio of extended chain anionic surfactant to linker surfactant is from 1:0.167 to 1:2.33 and the ratio of extended chain anionic surfactant to multiply charged cation is from 1:0.01 to 1:5.31.

20. The surfactant system of claim 19 wherein said extended surfactant is $C_{12\text{-}14}\text{-}(PO)_{16}\text{-}(EO)_2$-sulfate.

21. The surfactant system of claim 19 wherein said multiply charged cation is selected from the group consisting of Ca2+, Mg2+, a chelating agent, source of alkalinity or combinations thereof.

22. The surfactant system of claim 19 wherein said multiply charged cation is Mg2+.

23. The surfactant system of claim 19 wherein said surfactant system contains less than 0.1% unreacted alcohols.

24. A method of laundering a cleaning article that is contacted with a non-transfat, comprising:

providing a cleaning article that has been contacted with a non-trans fat;

washing the cleaning article;

rinsing the cleaning article;

drying the cleaning article; and treating the cleaning article with an effective amount of a composition comprising a surfactant system according to claim 1, wherein the treating occurs prior to or during the washing step.

* * * * *

UNITED STATES PATENT AND TRADEMARK OFFICE

CERTIFICATE OF CORRECTION

PATENT NO. : 9,109,190 B2
APPLICATION NO. : 14/246928
DATED : August 18, 2015
INVENTOR(S) : Man et al.

It is certified that error appears in the above-identified patent and that said Letters Patent is hereby corrected as shown below:

In the Claims

Col. 31, Claim 5, Line 50:
After is DELETE "Ma2+"
After is ADD --Mg2+--

Signed and Sealed this
Twenty-ninth Day of December, 2015

Michelle K. Lee

Michelle K. Lee
*Director of the United States Patent and Trademark Office*